US007954930B2

(12) United States Patent
Isozaki

(10) Patent No.: US 7,954,930 B2
(45) Date of Patent: Jun. 7, 2011

(54) LIQUID DROPLET EJECTING HEAD AND LIQUID DROPLET EJECTING APPARATUS

(75) Inventor: Jun Isozaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 851 days.

(21) Appl. No.: 11/936,160

(22) Filed: Nov. 7, 2007

(65) Prior Publication Data

US 2008/0129797 A1 Jun. 5, 2008

(30) Foreign Application Priority Data

Nov. 30, 2006 (JP) ..... 2006-323627
May 24, 2007 (JP) ..... 2007-138096

(51) Int. Cl.
*B41J 2/05* (2006.01)

(52) U.S. Cl. ..... 347/65

(58) Field of Classification Search ..... 347/84, 347/85, 89–91, 65
See application file for complete search history.

(56) References Cited

U.S. PATENT DOCUMENTS

| | | | | |
|---|---|---|---|---|
| 5,594,483 | A * | 1/1997 | Kaplinsky et al. | 347/87 |
| 5,975,681 | A * | 11/1999 | Ogasawara et al. | 347/47 |
| 6,059,395 | A * | 5/2000 | Takata et al. | 347/15 |
| 6,084,616 | A * | 7/2000 | Nakata et al. | 347/65 |
| 6,276,783 | B1 * | 8/2001 | Ishinaga et al. | 347/65 |
| 6,334,670 | B1 * | 1/2002 | Yoshihira et al. | 347/65 |
| 6,705,712 | B2 * | 3/2004 | Usui et al. | 347/86 |
| 6,840,603 | B2 * | 1/2005 | Barinaga et al. | 347/85 |
| 7,004,575 | B2 * | 2/2006 | Inoue et al. | 347/86 |
| 7,380,927 | B2 * | 6/2008 | Shigemura | 347/89 |
| 2002/0113845 | A1 * | 8/2002 | Yazawa et al. | 347/65 |
| 2004/0061748 | A1 * | 4/2004 | Kuwabara et al. | 347/85 |

FOREIGN PATENT DOCUMENTS

JP 2000-33714 2/2000

* cited by examiner

*Primary Examiner* — Charlie Peng
(74) *Attorney, Agent, or Firm* — Fildes & Outland, P.C.

(57) ABSTRACT

A liquid droplet ejecting head according to an aspect of the present invention includes a liquid droplet ejecting element for ejecting liquid droplets a liquid supply path having two or more flow ports, through which a liquid can flow, and supplying the liquid flowing in from the flow ports to the liquid droplet ejecting element, and a flow path cross-sectional area variable unit for changing the flow path cross-sectional area of the liquid supply path.

21 Claims, 14 Drawing Sheets

LIQUID DROPLET EJECTING HEAD AND LIQUID DROPLET EJECTING APPARATUS

CROSS-REFERENCE TO RELATED APPLICATION

This application is based on and claims priority under 35 USC 119 from Japanese Patent Application No. 2006-323627 filed Nov. 30, 2006 and No. 2007-138096 filed May 24, 2007.

BACKGROUND

1. Technical Field

The present invention relates to a liquid droplet ejecting head and a liquid droplet ejecting apparatus.

2. Related Art

As an example of a liquid droplet ejecting apparatus, there is known an inkjet recording apparatus for recording an image on a recording medium by ejecting ink droplets.

SUMMARY

An aspect of the present invention provides a liquid droplet ejecting head including: a liquid droplet ejecting element for ejecting liquid droplets; a liquid supply path having two or more flow ports, through which a liquid can flow, and supplying the liquid flowing in from the flow ports to the liquid droplet ejecting element; and a flow path cross-sectional area variable unit for changing the flow path cross-sectional area of the liquid supply path.

BRIEF DESCRIPTION OF THE DRAWINGS

Exemplary embodiments of the present invention will be described in detail based on the following figures, wherein.

DETAILED DESCRIPTION

Herebelow, an example of an exemplary embodiment of the present invention will be described in detail with reference to the drawings.

The example of the exemplary embodiment according to the present invention will be described below based on the drawings. In the exemplary embodiment, an inkjet recording head for recording an image on a recording medium by ejecting ink droplets will be explained as an example of a liquid droplet ejecting head for ejecting liquid droplets.

Further, an inkjet recording apparatus having the inkjet recording head and recording an image on a recording medium by ejecting ink droplets from the inkjet recording head will be explained as an example of the liquid droplet ejecting apparatus for ejecting liquid droplets.

Note that the liquid droplet ejecting apparatus and the liquid droplet ejecting head are not limited to those for recording an image, and the liquid to be ejected is not limited to ink. The liquid droplet ejecting apparatus and the liquid droplet ejecting head may be any of, for example, a color filter manufacturing apparatus for manufacturing a color filter by ejecting ink and the like onto a film and a glass, an apparatus for forming a part mounting bump by ejecting molten solder onto a substrate, an apparatus for forming a wiring pattern by ejecting a liquid metal, and various types of film forming apparatuses for forming a film by ejecting liquid droplets as long as they eject liquid droplets.

(Overall Configuration of Inkjet Recording Apparatus According to the Exemplary Embodiment)

Figure 1:
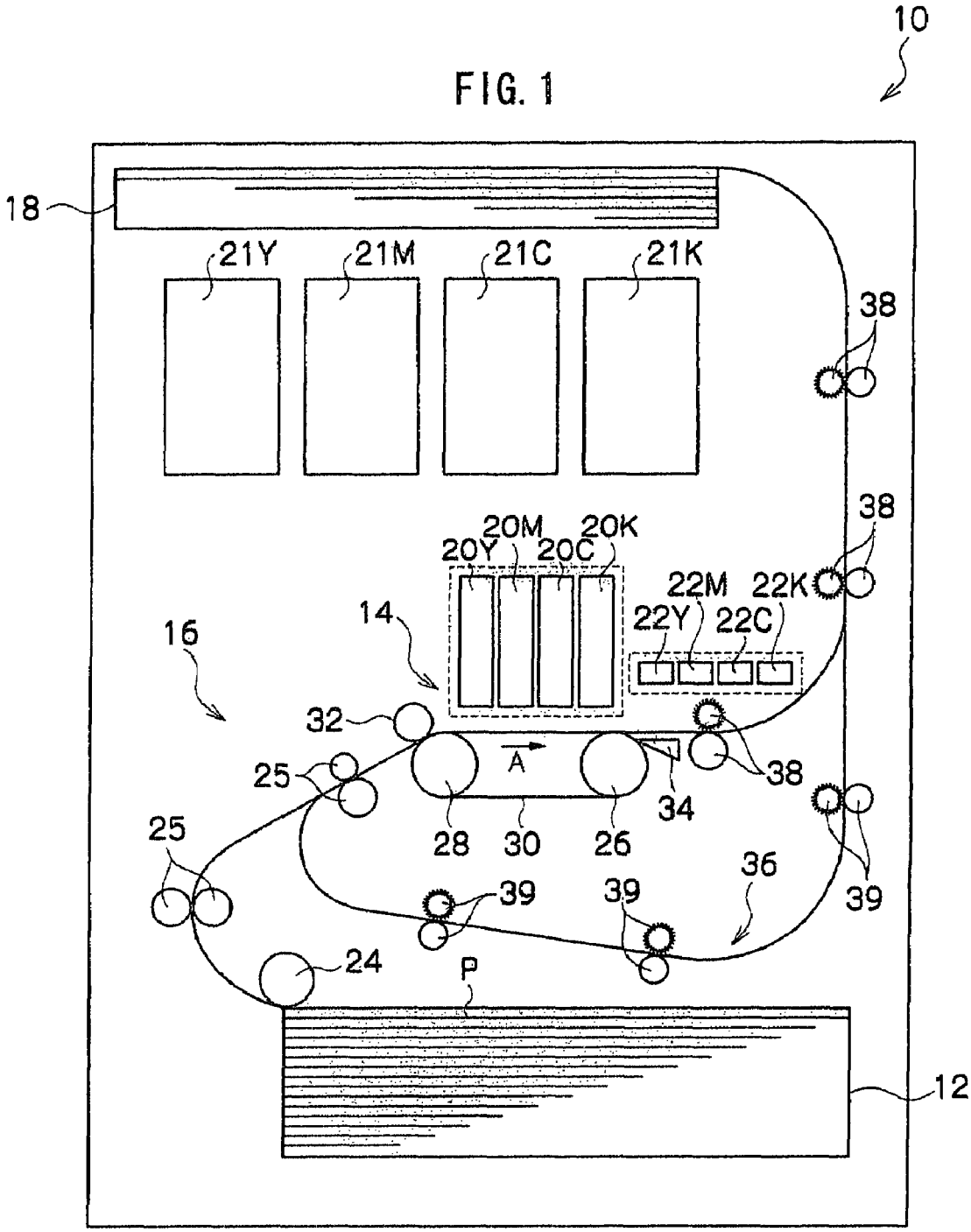
FIG. 1 is a schematic view showing the overall configuration of an inkjet recording apparatus according to an exemplary embodiment of the present invention.

First, the overall configuration of the inkjet recording apparatus according to the exemplary embodiment will be explained. FIG. 1 shows a schematic view of the overall configuration of the inkjet recording apparatus according to the exemplary embodiment.

As shown in FIG. 1, the inkjet recording apparatus 10 includes a recording medium accommodation portion 12 in which recording medium P such as sheets and the like are accommodated, an image recording portion 14 for recording an image on the recording medium P, a transport unit 16 for transporting the recording medium P from the recording medium accommodation portion 12 to the image recording portion 14, and a recording medium discharge portion 18 from which a recording medium P on which an image is recorded by the image recording portion 14 is discharged.

The image recording portion 14 includes inkjet recording heads 20Y, 20M, 20C, 20K (hereinafter, referred to as 20Y to 20K) for recording an image on a recording medium by ejecting ink droplets.

The inkjet recording heads 20Y to 20K are disposed in the sequence of the colors of yellow (Y), magenta (M), cyan (C), and block (K) from upstream of the transport direction of the recording medium P, and an image is recorded by ejecting ink droplets corresponding to the respective colors from a nozzle surface on which plural nozzles are formed.

Further, the inkjet recording heads 20Y to 20K have an image recordable width equal to or larger than the to-be-recorded region of the recording medium P, respectively. Note that the width is the length of a direction that intersects the transport direction of the recording medium P.

The inkjet recording apparatus 10 is provided with ink tanks 21Y, 21M, 21C, 21K for storing inks as an example of a liquid storage unit for storing liquids. Inks are supplied to the respective inkjet recording heads 20Y to 20K from the ink tanks 21Y, 21M, 21C, 21K. Note that various types of inks such as water-based ink, oil-based ink, solvent-based ink, can be used as the inks supplied to the inkjet recording heads 20Y to 20K.

Further the inkjet recording apparatus 10 is provided with maintenance units 22Y, 22M, 22C, and 22K (hereinafter, referred to as 22Y-22K) for carrying out the maintenance of the inkjet recording heads 20Y to 20K. The maintenance units 22Y-22K are arranged respectively such that they can move between the confronting positions confronting the nozzle surfaces of the inkjet recording heads 20Y to 20K and the evacuating positions evacuating from the nozzle surfaces of the inkjet recording heads 20Y to 20K (positions shown in FIG. 1).

Each of the maintenance units 22Y-22K includes a cap for covering the nozzle surface of the inkjet recording head 20, a receiving member for receiving liquid droplets subjected to preliminary ejection (empty ejection), a cleaning member for cleaning the nozzle surface of the inkjet recording head 20, and the like. As the maintenance of the respective inkjet recording heads 20Y to 20K, various types of maintenance are carried out by lifting the respective inkjet recording heads 20Y to 20K to a predetermined height as well as moving the maintenance units 22Y-22K to the confronting positions.

The transport unit 16 includes a feed roll 24 for feeding a recording medium P accommodated in the recording medium accommodation portion 12, a transport roll pair 25 for clamping and transporting the recording medium P fed by the feed roll 24, and an endless transport belt 30 for causing the to-be-recorded surface of the recording medium P transported by the transport roll pair 25 to confront the inkjet recording heads 20Y to 20K.

The transport belt 30 is stretched by a drive roll 26 disposed downstream of the transport direction of the recording medium P and a driven roll 28 disposed upstream of the transport direction of the record medium P so that it moves in circulation in a predetermined direction (direction A in FIG. 1).

Further, a press roll 32 is disposed on the driven roll 28 so as to be driven by the transport belt 30 as well as to press the recording medium P to the transport belt 30. The press roll 32 also acts as a charge roll, and when the transport belt 30 is charged by the press roll 32, the recording medium P is transported by being electrostatically adsorbed by the transport belt 30.

Note that the transport belt 30 is not limited to the configuration by which the recording medium P is held by being electrostatically adsorbed and may be arranged such that the recording medium P is held by the friction of the transport belt 30 with the recording medium P or by a non-electrostatic unit such as the suction and adhesion of the recording medium P.

Further, an exfoliation claw 34 is disposed downstream of the transport belt 30, which can approach to and separate from the transport belt 30, so that the recording medium P is exfoliated thereby from the transport belt 30. The recording medium P, on which the image is recorded by the inkjet recording heads 20Y to 20K, is exfoliated from the transport belt 30 by the curvature of the transport belt 30 and the exfoliation claw 34.

Plural transport roll pairs 38 whose to-be-recorded surface sides of the recording medium P are arranged as star wheels are disposed downstream of the exfoliation claw 34. The recording medium P on which the image is recorded by the image recording portion 14 is transported and discharged to the recording medium discharge portion 18 by the transport roll pairs 38.

Further, a reversing portion 36 is disposed below the transport belt 30 to reverse the recording medium P. After the transport roll pairs 38 transports the recording medium P downstream once, the transport roll pair 38 is rotated reversely so that the recording medium P is fed to the reversing portion 36.

Plural transport roll pairs 39 whose to-be-recorded surface sides of the recording medium P are arranged as star wheels are disposed to the reversing portion 36 to feed the recording medium P, which is fed to the reversing portion 36, to the transport belt 30 again.

Although not shown, the inkjet recording apparatus 10 includes a control unit of the inkjet recording heads 20Y to 20K and a system control unit for controlling the overall operation of the inkjet recording apparatus. The control unit determines timing at which ink droplets are ejected and the nozzles to be used according to an image signal and applies a drive signal to the nozzles.

Next, the image recording operation of the inkjet recording apparatus 10 will be explained.

First, a recording medium P is fed from the recording medium accommodation portion 12 by the feed roll 24 and sent to the transport belt 30 by the transport roll pair 25 disposed upstream of the transport belt 30.

The recording medium P sent to the transport belt 30 is adsorbed onto and held by the transport surface of the transport belt 30 and transported to the recording positions of the inkjet recording heads 20Y to 20K, and an image is recorded to the to-be-recorded surface of the recording medium P. Then, after the completion of recording of the image, the recording medium P is exfoliated from the transport belt 30 by the exfoliation claw 34.

When an image is recorded on only one surface of the recording medium P, it is discharged to the recording medium discharge portion 18 by the transport roll pairs 38 disposed downstream of the transport belt 30.

When images are recorded on both the surfaces of the recording medium P, after an image is recorded on one surface, the recording medium P is reversed by the reversing portion 36 and sent to the transport belt 30 again. When an image is recorded on an opposite surface likewise the above operation so that the images are recorded on both the surfaces of the recording medium P, the recording medium P is discharged to the recording medium discharge portion 18.

(Configuration of Inkjet Recording Head according to the Exemplary Embodiment)

Next, the configuration of the inkjet recording heads according to the exemplary embodiment will be explained. Since the inkjet recording heads 20Y to 20K have the same configuration, the configuration of them will be explained here as to the inkjet recording head 20Y as an example.

Figure 2:
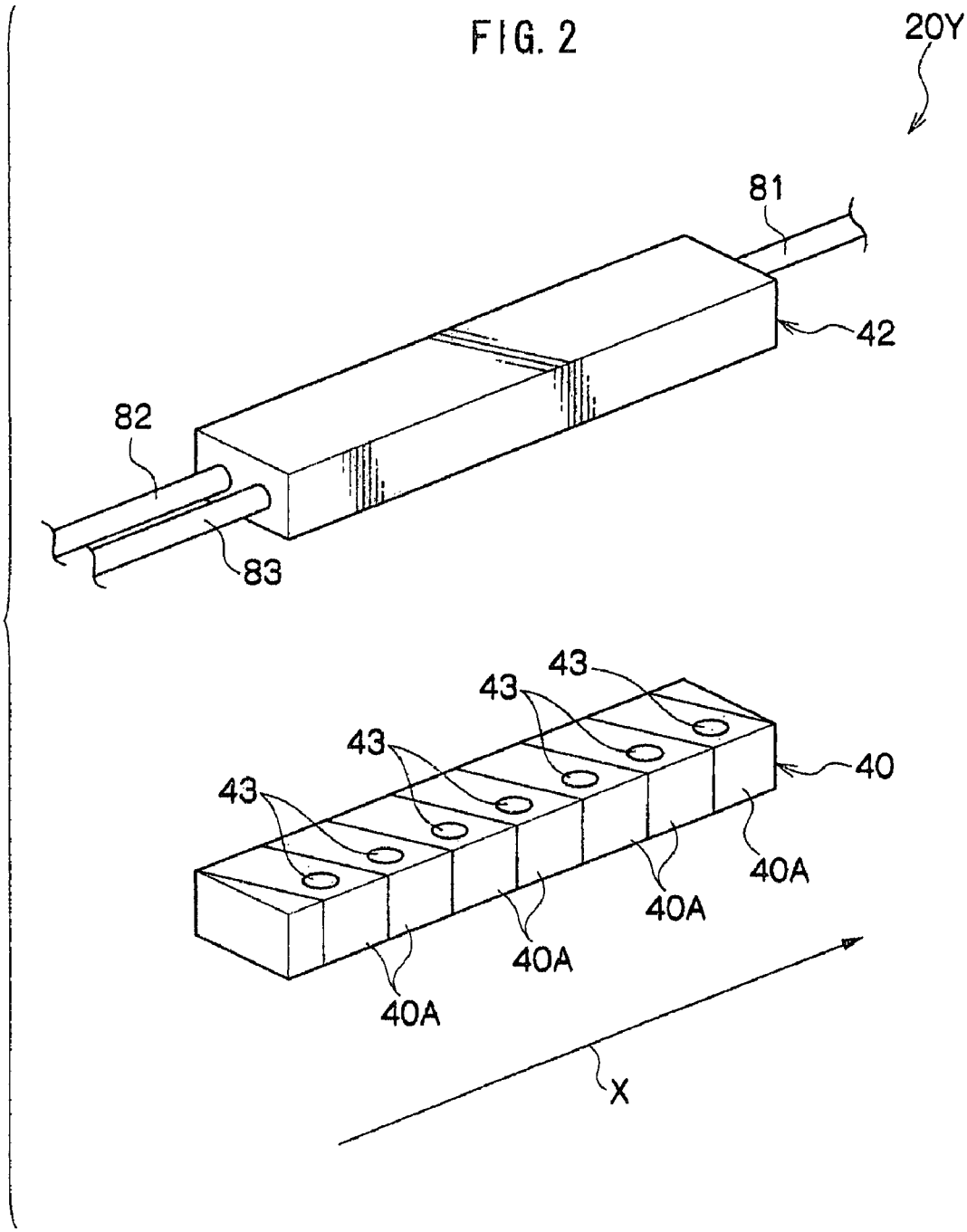
FIG. 2 is an exploded perspective view showing the configuration of an inkjet recording head according to the exemplary embodiment.
Figure 3:
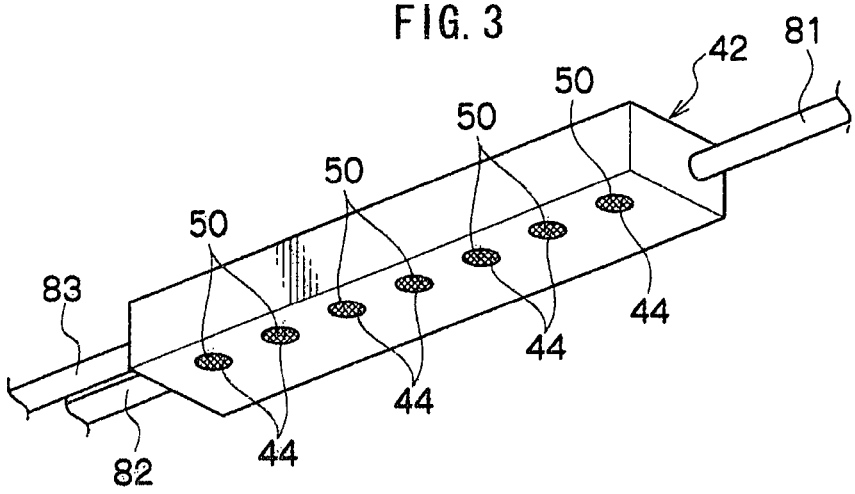
FIG. 3 is a perspective view of a common ink supply path block according to the exemplary embodiment when viewed from an ink outlet port side.

As shown in FIG. 2, the inkjet recording head 20Y includes a head unit portion 40 for ejecting ink droplets as an example of a liquid droplet ejecting element for ejecting liquid droplets. Further, as shown in FIGS. 2, 3, and 4, the inkjet recording head 20Y includes a common ink supply path block 42 for supplying ink to the head unit portion 40 as an example of a liquid supply pipe for supplying liquid to the liquid droplet ejecting element.

The head unit portion 40 is composed of plural head portions 40A for ejecting ink droplets arranged as a unit. The plural head portions 40A are disposed along an X-direction in the drawing. Note that the X-direction in the drawing is the longitudinal direction of the inkjet recording head 20Y and the common ink supply path block 42, the flow direction in which the ink flows in a common ink supply path 45, and the direction in which the head portions 40A are disposed.

Further, the liquid droplet ejecting element is not limited to the head unit portion 40 having plural head portions 40A and may be composed of a single head portion.

Figure 4:
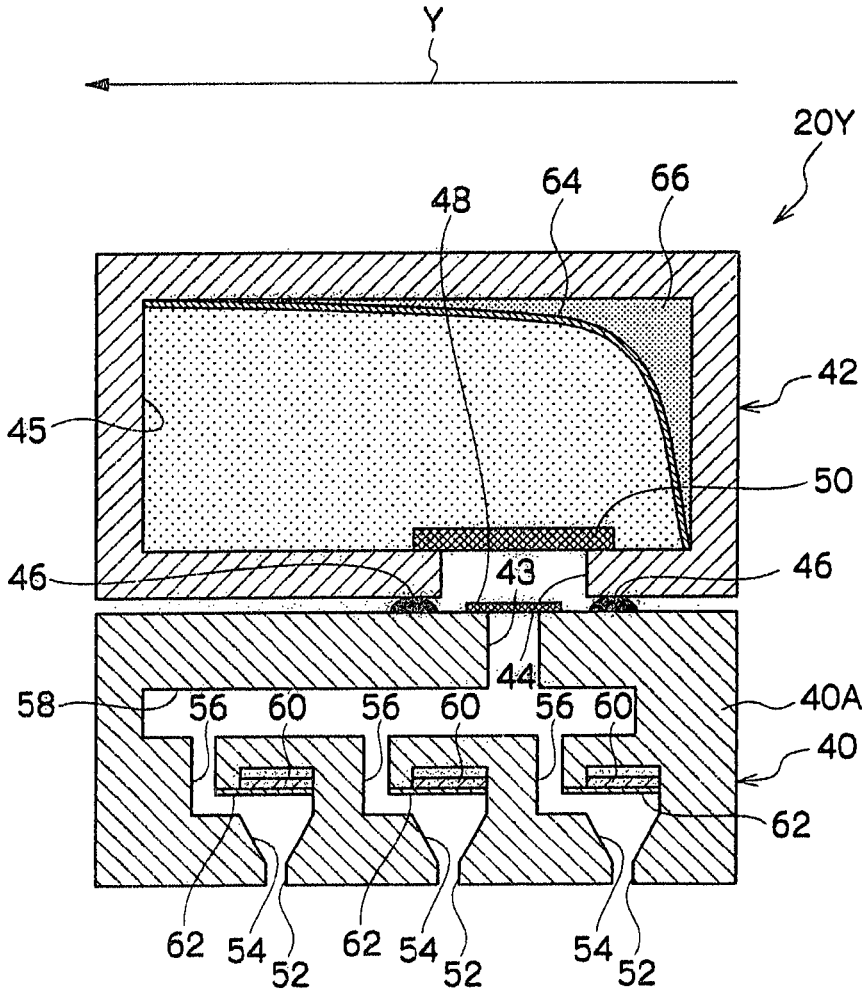
FIG. 4 is a cross-sectional view schematically showing the internal configuration of a head unit portion and the common ink supply path block according to the exemplary embodiment.

As shown in FIG. 4, each of the head portions 40A includes plural nozzles 52 for ejecting ink droplets, pressure chambers 54 communicating with the respective nozzles 52, supply paths 56 for supplying ink to the respective pressure chambers 54, a common liquid chamber 58 communicating with the respective supply paths 56, an ink inlet port 43 communicating with the common liquid chamber 58, vibration plates 62 constituting a part of the wall surface of the pressure chambers, and drive portions 60 for applying pressure to the ink in the respective pressure chambers 54. Note that the numbers, disposition, and sizes of the respective portions constituting the head portion 40A may be arbitrarily set, and the configuration of the head portion 40A is not limited to the configuration shown in FIG. 4.

With the above configuration, the ink supplied from the common ink supply path block 42 to the head portion 40A flows in from the ink inlet port 43, flows to the respective nozzles 52 through the common liquid chamber 58, the respective supply paths 56, and the respective pressure chambers 54, and the common liquid chamber 58, the respective supply paths 56, the respective pressure chambers 54, and respective nozzles 52 are filled with the ink.

When the drive portion 60 is driven in the state that the respective portions are filled with the ink, the vibration plates 62 are deformed so as to reduce the volume in the pressure chambers 54 so that pressure is applied to the ink in the pressure chambers 54. With this operation, ink droplets are ejected from the nozzles 52 communicating with the pressure chambers 54.

Note that, as a system for ejecting ink droplets in the liquid droplet ejecting element, a thermal system and the like may be employed in addition to a piezoelectric system as long as they are arranged to eject ink droplets.

The common ink supply path block 42 is formed in a rectangular parallelepiped shape (refer to FIGS. 2 and 3) and placed on and joined to the upper portion of the head unit portion 40 (refer to FIG. 4). As shown in FIG. 3, plural ink outlet ports 44 are formed on the lower surface of the common ink supply path block 42 so that the ink flows out therefrom.

On the other hand, ink inlet ports 43, which are connected to the ink outlet ports 44, are formed on the upper surfaces of the respective head portions 40A constituting the head unit portion 40 so that the ink flowing out from the ink outlet ports 44 flows into the ink inlet ports 43. That is, the ink outlet ports 44 act as ink supply ports for supplying the ink to the head unit portion 40 through the ink inlet ports 43.

As shown in FIG. 4, packings 46 are disposed to the outer peripheries of the joint portions between the ink inlet ports 43 and the ink outlet ports 44 to prevent the leakage of ink from the joint portions between the ink inlet ports 43 and the ink outlet ports 44.

Filters 48 are disposed on the upper surfaces of the respective head portions 40A to remove foreign substances mixed in the ink. The filters 48 are placed on the ink inlet ports 43 so as to cover them to thereby remove the foreign substances mixed in the ink that flows in the ink inlet ports 43.

Filters 50 are disposed on the inside wall of the common ink supply path block 42 to remove the foreign substances mixed in the ink. The filters 50 are placed on the ink outlet ports 44 so as to cover them to thereby remove the foreign substances in the ink which flow out from the ink outlet ports 44.

The common ink supply path 45, which supplies the ink to the head unit portions 40, is formed in the common ink supply path block 42 as an example of a liquid supply path for supplying liquid to the liquid droplet ejecting element. The common ink supply path 45 communicates with the respective ink inlet ports 43 through the respective ink outlet ports 44 so that the ink is supplied from the common ink supply path 45 to the respective head portions 40A through the respective ink outlet ports 44.

Figure 5:
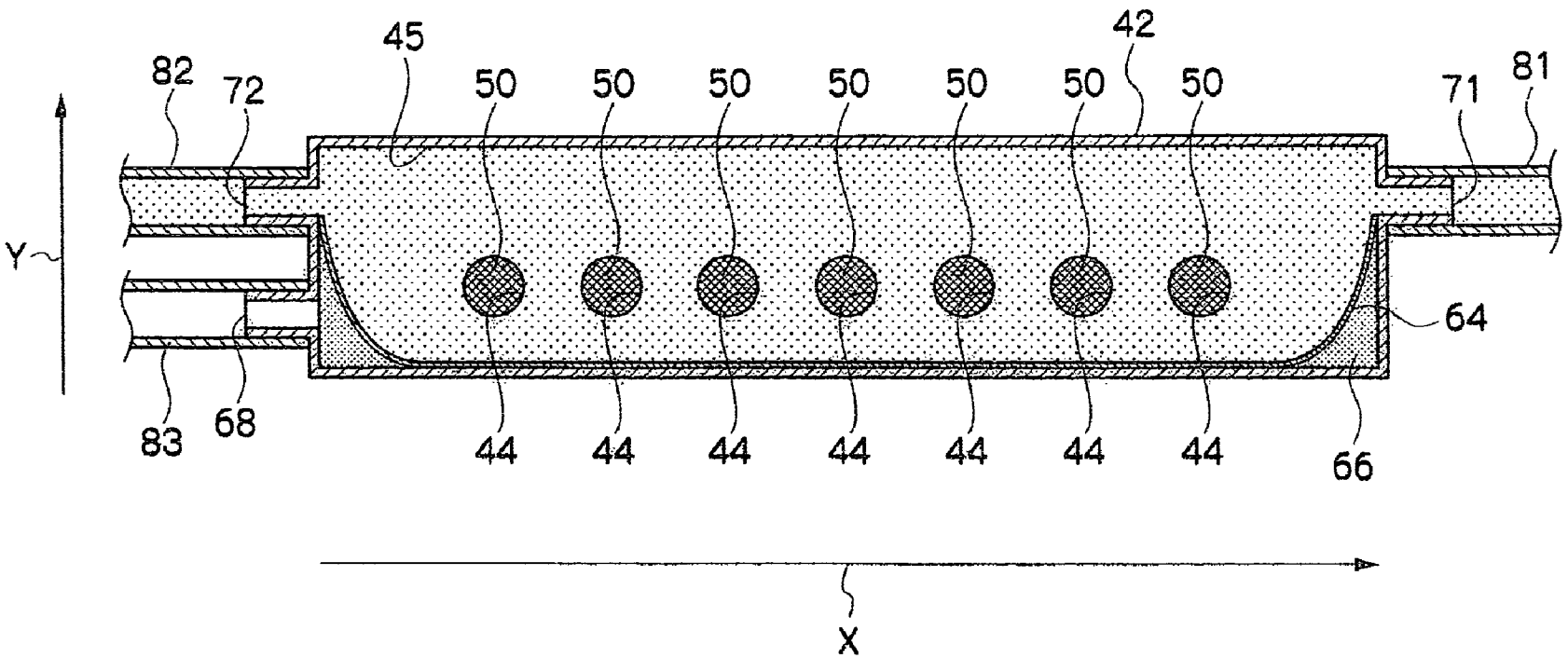
FIG. 5 is a cross-sectional view showing the common ink supply path block according to the exemplary embodiment.

Further, as shown in FIG. 5, the common ink supply path 45 has a first flow port 71 and a second flow port 72 through which the ink can flow. That is, the common ink supply path 45 according to the exemplary embodiment has two flow ports. Note that the number of flow ports may be two or more, not limited to two.

The first flow port 71 is formed at one end in the longitudinal direction of the common ink supply path block 42, and the second flow port 72 is formed at the other end in the longitudinal direction of the common ink supply path block 42. Further, the first flow port 71 and the second flow port 72 are formed by being offset to one side in a Y-direction in the drawing. Note that the Y-direction in the drawing is a direction along the transport direction of the recording medium P, a direction that intersects the X-direction, and a latitudinal direction of the common ink supply path 45 when viewed from an upper side.

Figure 6:
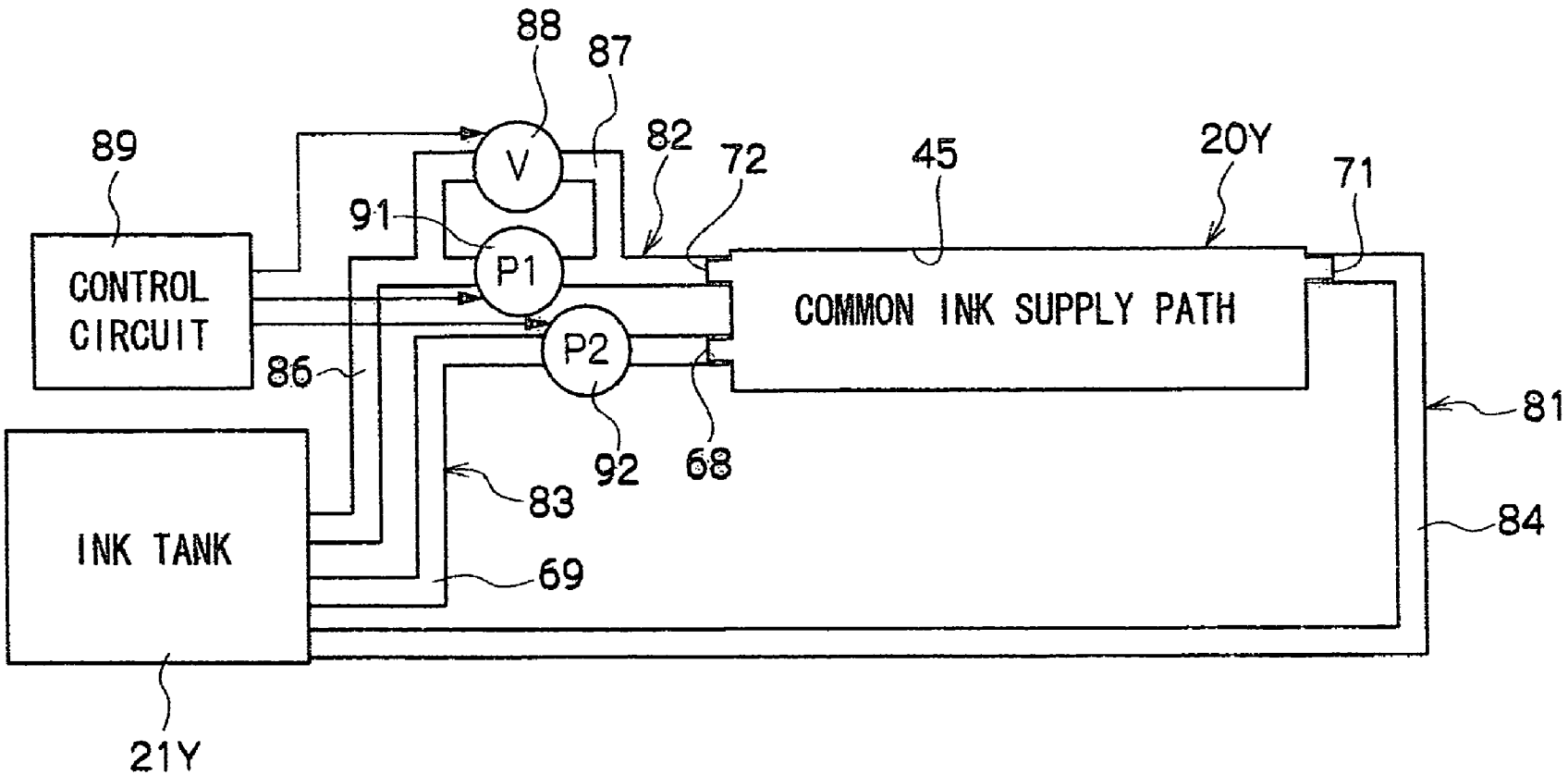
FIG. 6 is a block diagram schematically showing the internal configuration of the inkjet recording apparatus according to the exemplary embodiment.

As shown in FIGS. 5 and 6, one end portion of a first tube 81 is connected to the first flow port 71 as an example of a flow pipe through which the ink flow. The other end of the first tube 81 is connected to the ink tank 21Y. A flow path 84, which causes the ink to flow therethrough, is formed in the first tube 81, thereby the ink can flow in both directions between the ink tank 21Y and the common ink supply path block 42 through the first flow port 71.

As shown in FIGS. 5 and 6, one end portion of a second tube 82 is connected to the second flow port 72 as an example of a flow pipe through which the ink flow. The other end portion of the second tube 82 is connected to the ink tank 21Y. A flow path 86, which causes the ink to flow from ink tank 21Y to the common ink supply path block 42, and a bypath 87 communicating with the flow path 86 are formed in the second tube 82.

A first tube pump 91, which removes bubbles from the common ink supply path 45, is disposed to the second tube 82 as an example of a bubble removal unit for removing bubbles from the liquid supply path. The first tube pump 91 has a not shown rotary member which has the second tube 82 around the outside periphery thereof, and the second tube 82 is crushed by a part of the outside periphery of the rotary member.

A control circuit 89, which constitutes a control unit, is connected to the first tube pump 91, and the drive of the first tube pump 91 is controlled by the control circuit 89.

When a drive signal is input from the control circuit 89 to the first tube pump 91, the rotary member of the first tube pump 91 rotates in the state that the second tube 82 is crushed thereby and supplies the ink from the ink tank 21Y to the common ink supply path 45 through the second flow port 72 by squeezing the second tube 82.

With this operation, the ink containing bubbles is discharged from the common ink supply path 45 through the first flow port 71, whereas the ink, which does not contain bubbles, is sent from the ink tank 21Y to the common ink supply path 45 through the second flow port 72, thereby bubbles are removed from the common ink supply path 45. As described above, when bubbles are removed, the second flow port 72 acts as a supply port for supplying the ink to the common ink supply path 45, and the first flow port 71 acts as a discharge port for discharging the ink from the common ink supply path 45.

Note that the bubble removal unit is not limited to the tube pump but may be other pump that is any liquid feeder as long as it can supply liquid.

Further, although the ink is caused to flow from the ink tank 21Y in the sequence of the second flow port 72, the common ink supply path 45, the first flow port 71, and the ink tank 21Y in the example, bubbles may be removed by causing the ink to flow in an opposite sequence.

The bypath 87 has one end portion communicating with the flow path 86 between the first tube pump 91 and the ink tank 21Y and the other end portion communicating with the flow path 86 between the first tube pump 91 and the second flow port 72.

The bypath 87 is provided with a valve 88 for stopping the flow of the ink as an example of a flow stop unit for stopping the flow of the liquid. The control circuit 89 is connected the valve 88, and the drive of the valve 88 is controlled by the control circuit 89.

Since the valve 88 is opened in the state that a drive signal is not input from the control circuit 89, the ink can be caused to flow in the bypath 87. Further, since the valve 88 is closed when a drive signal is input from the control circuit 89 to the valve 88, the ink cannot be caused to flow in the bypath 87.

(First Example of Configuration for Changing Flow Path Cross-Sectional Area of Common Ink Supply Path)

Next, a first example of the configuration for changing the flow path cross-sectional area of the common ink supply path will be explained.

As shown in FIG. 5, an inkjet recording head 20Y according to the first example includes a cross-sectional area adjustment chamber 66, which is formed of a flexible film member 64 and a wall surface of the common ink supply path 45, and a medium supply/discharge port 68, which can supply a medium to the cross-sectional area adjustment chamber 66 as well as can discharge the medium from the cross-sectional area adjustment chamber 66, as an example of a flow path cross-sectional area variable unit for changing the flow path cross-sectional area of the common ink supply path 45.

The film member 64 is disposed in the common ink supply path 45 and partitions the inside of the common ink supply path 45 to two spaces. One of the spaces constitutes the flow path of the common ink supply path 45, and the other space constitutes the cross-sectional area adjustment chamber 66 for adjusting the flow path cross-sectional area of the common ink supply path 45.

The upper end portion of the film member 64 is fixed to the upper wall surface in the Y-direction in the drawing on the side where the first flow port 71 and the second flow port 72 are located, and the lower end portion of the film member 64 is fixed to the lower wall surface in the Y-direction in the drawing where the first flow port 71 and the second flow port 72 are not located. Further, the side end portion of the film member 64 is fixed to the side wall surface of the common ink supply path 45, to which the first flow port 71 is formed, and to the side wall surface of the common ink supply path 45, to which the second flow port 72 is formed, respectively.

Further, the film member 64 may have such a low degree of permeability as to maintain the shape and position of the film member 64 by the pressure difference between the outside and the inside of the film member 64 when the same ink as the ink to be ejected is used as a medium. Further, when a fluid member to be described below other than the ink is used as a medium, it is sufficient for the film member 64 to have permeability which prevents transmission of the fluid member.

The first flow port 71, the second flow port 72, and the ink outlet ports 44 are formed to the flow path side wall surface of the common ink supply path 45. On the other hand, the medium supply/discharge port 68 is formed to the cross-sectional area adjustment chamber 66 side wall surface of the common ink supply path 45, thereby the medium can be supplied to the cross-sectional area adjustment chamber 66 as well as the medium can be discharged from the cross-sectional area adjustment chamber 66.

As shown in FIG. 6, one end portion of a third tube 83 is connected to the medium supply/discharge port 68 as an example of a flow pipe for causing the ink to flow. The other end portion of the third tube 83 is connected to the ink tank 21Y The third tube 83 is provided with a second tube pump 92 as an example of a medium supply/discharge unit for supplying the medium to the cross-sectional area adjustment chamber 66 through the medium supply/ discharge port 68 as well as discharging the medium from the cross-sectional area adjustment chamber 66 through the medium supply/discharge port 68.

The medium supply/discharge unit is not limited to the tube pump but may be other pump, and further any medium supply/discharge device as long as it can supply the medium to the cross-sectional area adjustment chamber 66 as well discharge the medium from the cross-sectional area adjustment chamber 66.

In the example shown in FIG. 6, the ink stored in the ink tank 21Y is used as the medium. Note that the medium may be the ink stored separately from the ink tank 21Y, and the medium is not limited to the ink, but may be other liquid stored separately from the ink tank 21Y. Further, the medium is not limited to a liquid but may be a fluid member having fluidity as long as it can be supplied to the cross-sectional area adjustment chamber 66 and can be discharged from the cross-sectional area adjustment chamber 66. The fluid member is, for example, a gas, a jelly-like substance, powder, and the like in addition to the liquid.

The second tube pump 92 includes a not shown rotary member which has the third tube 83 around the outside periphery thereof, and the third tube 83 is crushed by a part of the outside periphery of the rotary member.

Figure 7A:
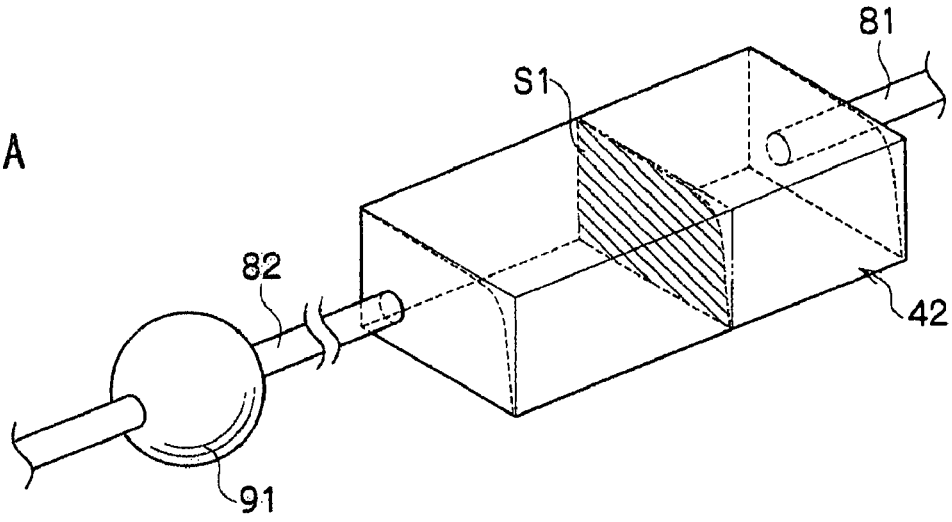
FIG. 7A is a perspective view showing a change of the flow path cross-sectional area of a common ink supply path according to the exemplary embodiment.
Figure 7B:
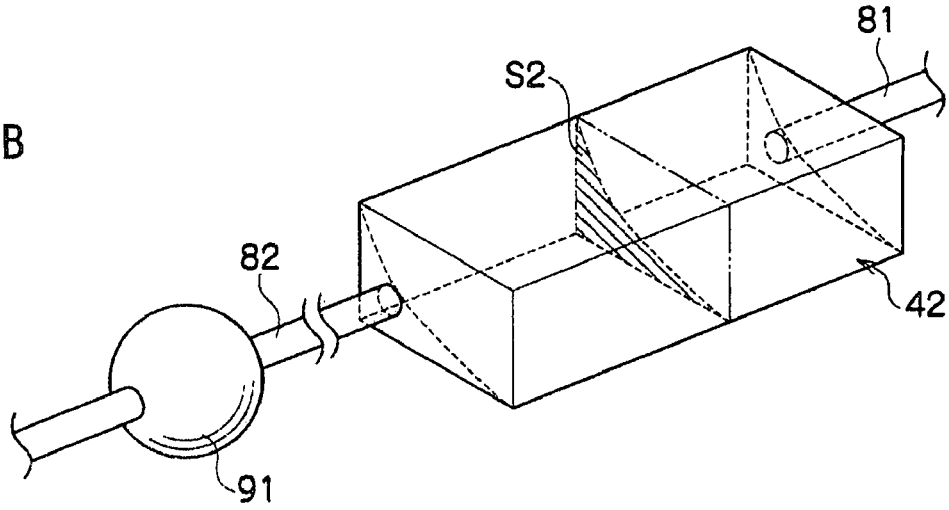
FIG. 7B is a perspective view showing a change of the flow path cross-sectional area of the common ink supply path according to the exemplary embodiment.

The control circuit 89 is connected to the second tube pump 92, and the drive of the second tube pump 92 is controlled by the control circuit 89. When a drive signal is input to the second tube pump 92 from the control circuit 89 and the rotary member is rotated forward in the state that the third tube 83 is crushed, the ink in the ink tank 21Y is supplied to the cross-sectional area adjustment chamber 66 through the medium supply/discharge port 68 because the third tube 83 is squeezed by the rotary member. With this operation, as shown in FIG. 7B, the flow path cross-sectional area S2 of the common ink supply path 45 when the ink is supplied to the cross-sectional area adjustment chamber 66 is made smaller than the flow path cross-sectional area SI of the common ink supply path 45 when the ink is discharged from the cross-sectional area adjustment chamber 66. As described above, when the flow path cross-sectional area is made smaller, the current of the ink flowing in the flow path of the common ink supply path 45 is increased.

Further, when a drive signal is input from the control circuit 89 to the second tube pump 92 and the rotary member is rotated reversely, the third tube 83 is squeezed by the rotary member, thereby the ink in the cross-sectional area adjustment chamber 66 is discharged through the medium supply/ discharge port 68 and supplied to the ink tank 21Y. With this operation, as shown in FIG. 7A, the flow path cross-sectional area S1 of the common ink supply path 45 when the ink is discharged from the cross-sectional area adjustment chamber 66 is made larger than the flow path cross-sectional area S2 of the common ink supply path 45 when the ink is supplied to the cross-sectional area adjustment chamber 66.

Note that the flow path cross-sectional area is the average cross-sectional area obtained by dividing, when the bubbles are removed, the volume of the common ink supply path 45 between the supply port for supplying the ink to the common ink supply path 45 and the discharge port for discharging the ink from the common ink supply path 45 by the distance between the supply port and the discharge port. In the exemplary embodiment, the supply port is the first flow port 71, and the discharge port is the second flow port 72.

(Operation of Inkjet Recording Apparatus according to the Exemplary Embodiment)

Next, the operation of the inkjet recording apparatus according to the exemplary embodiment will be explained.

When an image is recorded on a recording medium P by ejecting ink droplets, since the control circuit 89 does not input a drive signal to the first tube pump 91, the first tube pump 91 does not operate. Further, since the control circuit 89 does not input a drive signal to the valve 88, the valve 88 is opened.

Accordingly, when ink droplets are ejected from the nozzles 52 of the respective head portions 40A, an amount of ink consumed is supplied to the common ink supply path block 42 from the ink tank 21Y through the bypath 87. Further, ink is supplied from the ink tank 21Y to the common ink supply path block 42 through the flow path 84. The ink sent to the common ink supply path block 42 is supplied to the respective head portions 40A.

When bubbles are removed from the common ink supply path 45, first, the control circuit 89 inputs a drive signal to the second tube pump 92 and rotates the second tube pump 92 forward, thereby the ink as a medium is supplied from the ink tank 21Y to the cross-sectional area adjustment chamber 66.

When the ink is supplied to the cross-sectional area adjustment chamber 66, the cross-sectional area adjustment chamber 66 gradually enlarges as shown in FIGS. 8A, 8B, 8C, 8D and FIGS. 9A and 9B, thereby the bubbles in the common ink supply path 45 are forcibly moved to the sides where the first flow port 71 and the second flow port 72 are formed in the Y-direction in the drawing.

As described above, when the ink is supplied to the cross-sectional area adjustment chamber 66, the flow path cross-sectional area S2 of the common ink supply path 45 when the ink is supplied to the cross-sectional area adjustment chamber 66 is made smaller than the flow path cross-sectional area SI of the common ink supply path 45 when the ink is discharged from the cross-sectional area adjustment chamber 66 (refer to FIG. 7B).

Next, the second tube pump 92 is stopped by the control circuit 89 as well as the control circuit 89 closes the valve 88 by inputting a drive signal to the valve 88.

Figure 9A:
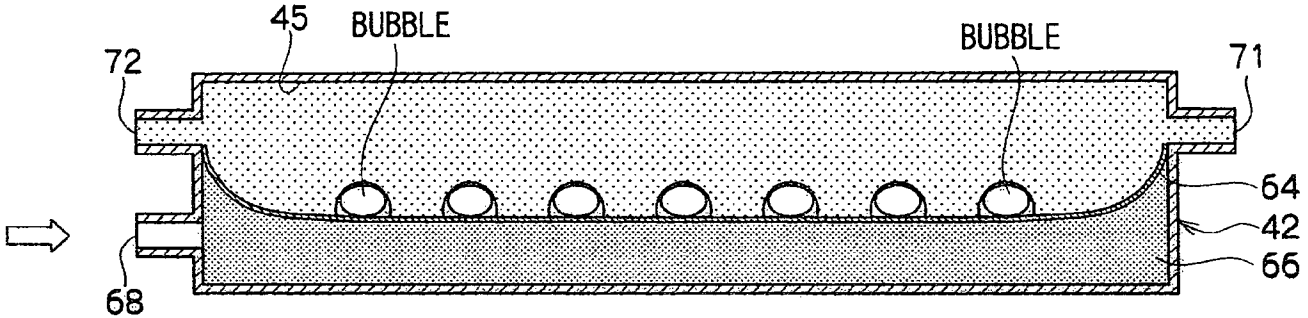
FIG. 9A is a plan cross-sectional view showing how the cross-sectional area adjustment chamber according to the exemplary embodiment increases.
Figure 9B:
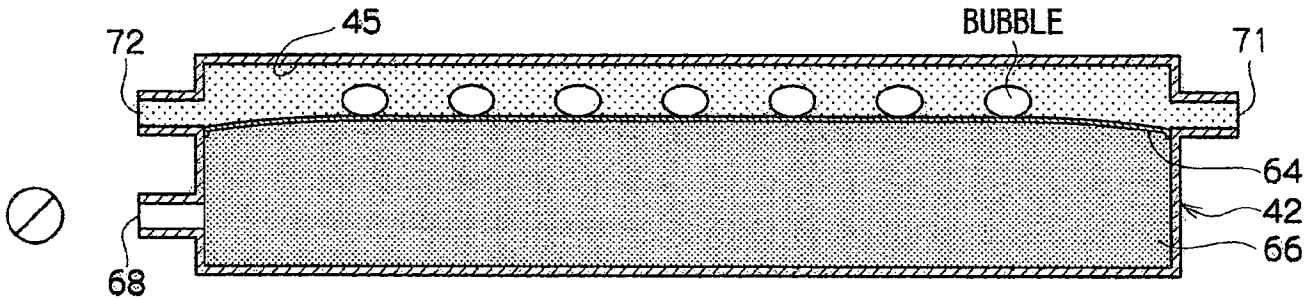
FIG. 9B a plan cross-sectional view is showing how the cross-sectional area adjustment chamber according to the exemplary embodiment increases.
Figure 9C:
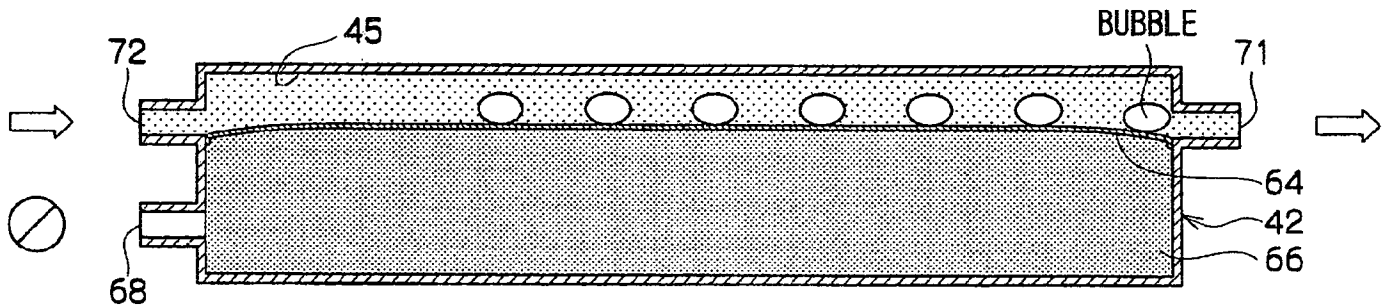
FIG. 9C a plan cross-sectional view showing how the cross-sectional area adjustment chamber according to the exemplary embodiment increases.

Next, the control circuit 89 operates the first tube pump 91 by inputting a drive signal to the first tube pump 9land forcibly flows the ink from the ink tank 21Y to the common ink supply path block 42 (refer to FIG. 9C). At this time, the current of the ink flowing in the flow path of the common ink supply path 45 is increased as compared with the case that the flow path cross-sectional area is large because the flow path cross-sectional area is made smaller.

As described above, the ink stored to the ink tank 21Y is caused to flow from the second flow port 72 to the common ink supply path 45 by forcibly flowing the ink from the ink tank 21Y to the common ink supply path block 42. The ink, which flows into the common ink supply path 45, flows out from the first flow port 71 and returns to the ink tank 21Y through the flow path 84.

That is, in the exemplary embodiment, the ink circulates in the sequence of the ink tank 21Y, the flow path 86, the common ink supply path 45, the flow path 84, and the ink tank 21Y. The ink containing bubbles is returned from the common ink supply path 45 to the ink tank 21Y, bubbles are removed in the ink tank 21Y, and the ink, from which the bubbles are removed, is sent to the common ink supply path 45. As described above, in the common ink supply path 45, the bubbles deposited on the filters 50 and the wall surface of the common ink supply path 45 are removed from the common ink supply path 45.

Note that the ink tank 21Y is provided with a not shown bubble removing mechanism for removing bubbles, thereby bubbles are removed from the ink supplied from the common ink supply path 45 and containing bubbles. Note that a configuration for removing bubbles from ink by opening the ink tank 21Y to the atmosphere, for example, is available as the bubble removing mechanism.

Further, although the ink is circulated in the above example, a collection device for collecting the ink discharged from the common ink supply path 45, that is, the ink containing bubbles may be disposed separately from the ink tank 21Y so that the ink containing no bubble is supplied from the ink tank 21Y.

(Second Example of Configuration for Changing Flow Path Cross-Sectional Area of Common Ink Supply Path 45)

Next, a second example of the configuration for changing the flow path cross-sectional area of the common ink supply path 45 will be explained.

Figure 10A:
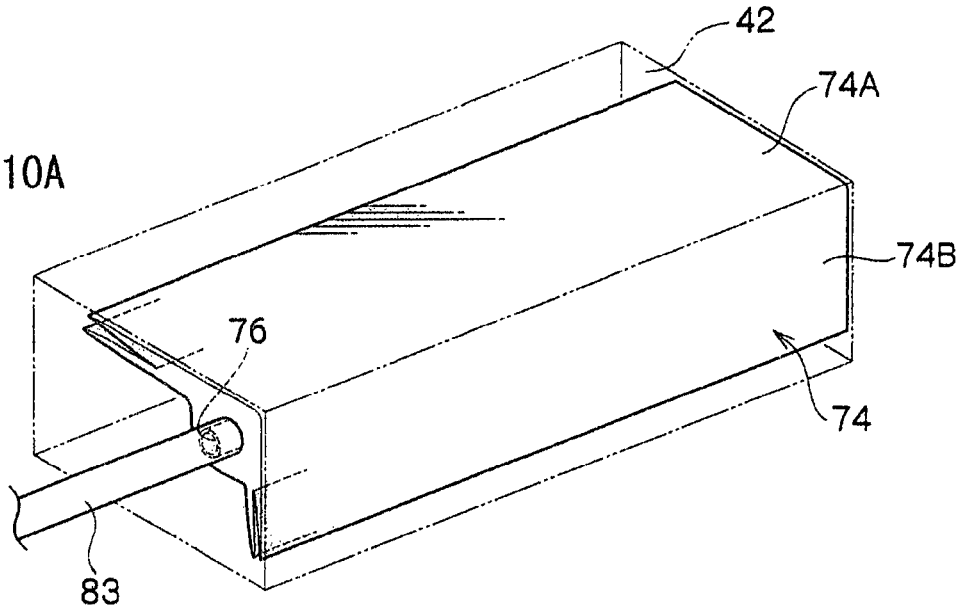
FIG. 10A is a perspective view showing a second example of the configuration for changing the flow path cross-sectional area of the common ink supply path according to the exemplary embodiment.
Figure 10B:
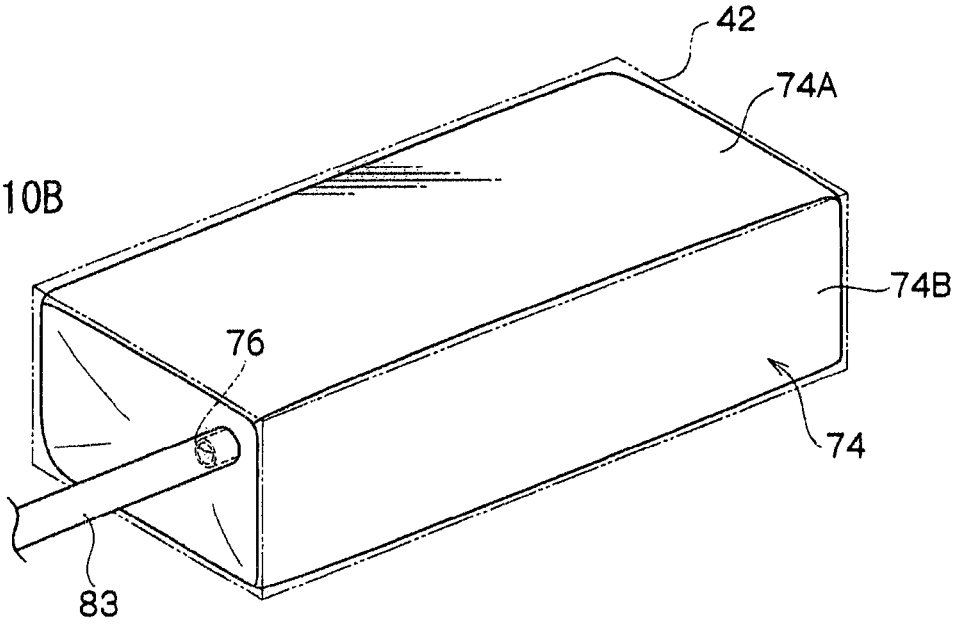
FIG. 10B is a perspective view showing the second example of the configuration for changing the flow path cross-sectional area of the common ink supply path according to the exemplary embodiment.
Figure 11A:
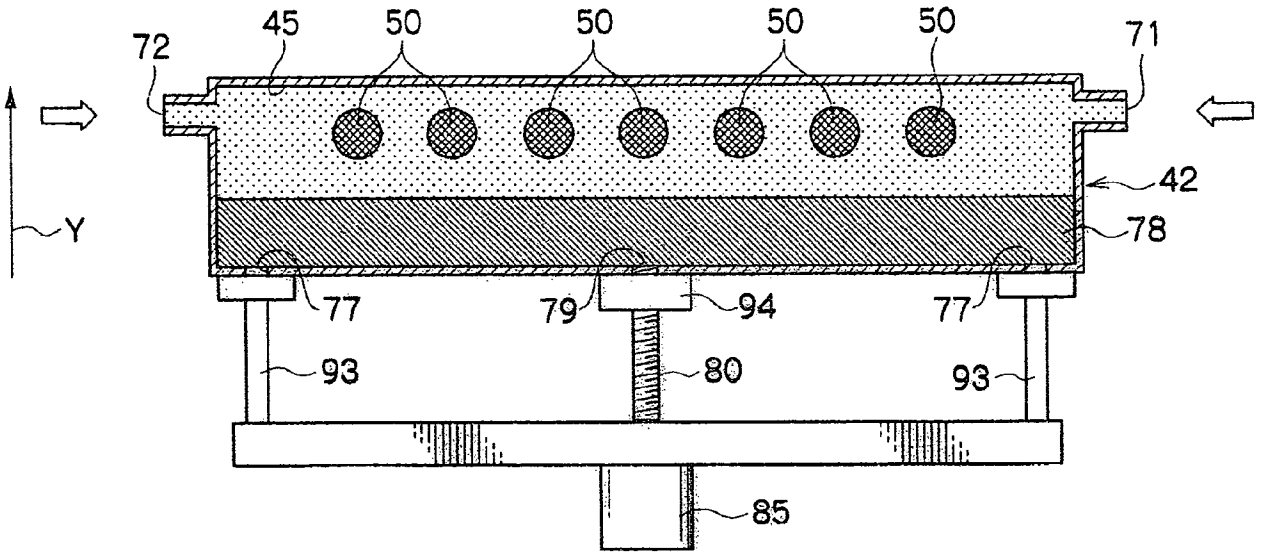
FIG. 11A is a plan cross-sectional view showing a third example of the configuration for changing the flow path cross-sectional area of the common ink supply path according to the exemplary embodiment.
Figure 11B:
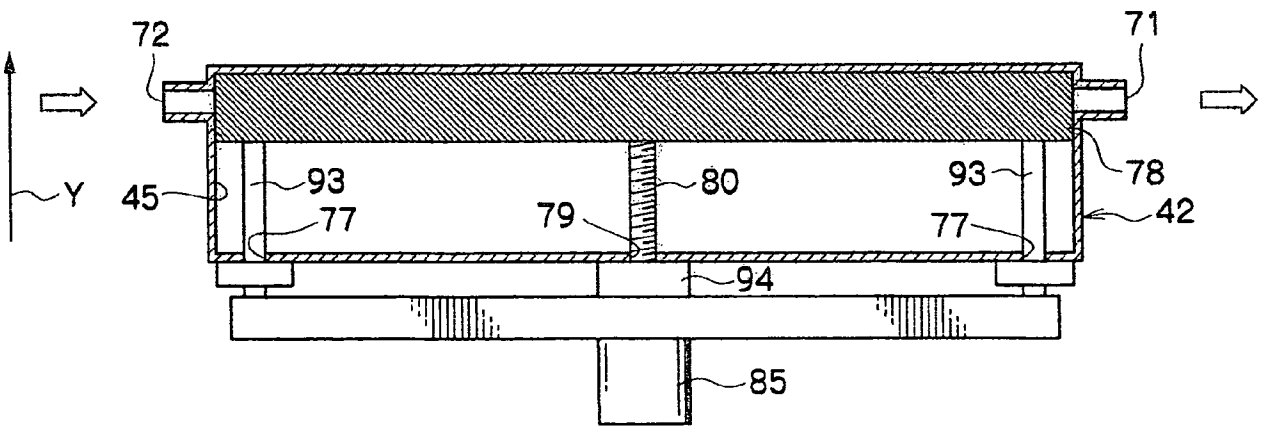
FIG. 11B a plan cross-sectional view showing the third example of the configuration for changing the flow path cross-sectional area of the common ink supply path according to the exemplary embodiment.

As shown in FIGS. 10A and 10B, an inkjet recording head 20Y according to the second example includes a flexible bag member 74 disposed in the common ink supply path 45 and a medium supply/exhaust port 76, which can supply a medium to the inside of the bag member 74 as well as can discharge the medium from the inside of the bag member 74, as an example of a flow path cross-sectional area variable unit for changing the flow path cross-sectional area of the common ink supply path 45.

The upper surface 74A of the bag member 74 is fixed to the upper wall surface of the common ink supply path 45 by an adhesive and the like. Further, one side surface 74B of the bag member 74 is fixed to a side wall surface of the common ink supply path 45 by an adhesive and the like.

The bag member 74 has a crimp along which the bag member 74 is folded inward, that is, a godet formed thereto so that when the medium is supplied to the inside of the bag member 74, the bag member 74 spreads in a rectangular parallelepiped shape in conformity to the shape of the common ink supply path 45 (refer to FIG. 10B). On the other hand, when the medium supplied to the inside of the bag member 74 is discharged from the bag member 74, the bag member 74 is reduced to a flat state (refer to FIG. 10A). Note that the ink stored in the ink tank 21Y and other fluid member may be used as the medium likewise the first example.

Further, the bag member 74 may have such a low degree of permeability as to maintain the shape and position of the bag member 74 by the pressure difference between the outside and the inside of the bag member 74 when the same ink as the ink to be ejected is used as a medium. Further, when a fluid member other than the ink is used as a medium, it is sufficient for the bag member 74 to have permeability which prevents transmission of the fluid member.

The medium supply/discharge port 76 is formed to the bag member 74, and a third tube 83 is connected to the medium supply/discharge port 76 likewise the first example. The third tube 83 is provided with a second tube pump 92 likewise the first example, and the ink in the ink tank 21Y is sent by the second tube pump 92 to the inside of the bag member 74 through the medium supply/discharge port 76.

With this configuration, the flow path cross-sectional area S2 of the common ink supply path 45 when the ink is supplied to the inside of the bag member 74 is made smaller than the flow path cross-sectional area S1 of the common ink supply path 45 when the ink is discharged from the inside of the bag member 74 (refer to FIG. 7B). When the flow path cross-sectional area is made smaller as described above, the current of the ink flowing in the flow path of the common ink supply path 45 is increased.

Further, the ink in the inside of the bag member 74 is discharged by the second tube pump 92 through the medium supply/discharge port 76 and sent to the ink tank 21Y With this operation, the flow path cross-sectional area S1 of the common ink supply path 45 when the ink is discharged from the inside of the bag member 74 is made larger than the flow path cross-sectional area S2 of the common ink supply path 45 when the ink is supplied to the inside of the bag member 74 (refer to FIG. 7A).

According to the configuration of the inkjet recording head 20Y of the second example, it has the same operation as the inkjet recording head 20Y of the first example.

Note that the bag member 74 may have other shape as long as the shape is formed such that when the ink is supplied to the inside of the bag member 74, the flow path cross-sectional area is made smaller as well as the first flow port 71 and the second flow port 72 are not closed thereby.

(Third Example of Configuration for Changing Flow Path Cross-Sectional Area of Common Ink Supply Path)

Next, a third example of the configuration for changing the flow path cross-sectional area of the common ink supply path will be explained.

As shown in FIGS. 11A, 11B, 12A, and 12B, an inkjet recording head 20Y according to the third example includes a movable member, which constitutes a part of a wall surface of the common ink supply path 45 as well as can move in a direction in which the flow path cross-sectional area of the common ink supply path 45 is changed, as an example of a flow path cross-sectional area variable unit for changing the flow path cross-sectional area of the common ink supply path 45.

In the configuration of the third example, a seal member 78, which comes into intimate contact with the wall surface of the common ink supply path 45 and moves in the state that the common ink supply path 45 is sealed thereby, is used as an example of the movable member.

The seal member 78 is disposed so as to move along a Y-direction in the drawing and arranged to move forward to the side of the first flow port 71 and the second flow port 72 and to move rearward to an opposite side.

Further, the inkjet recording head 20Y of the third example includes a screw member 80 having a screw groove formed around the outer periphery thereof and a drive portion 85 for rotating the screw member 80 as an example of a movement unit for moving the movable member. The control circuit 89 is connected to the drive portion 85, and the rotation of the screw member 80 rotated by the drive portion 85 is controlled by the control circuit 89.

The screw member 80 is inserted into a circular hole 79 formed to a side surface of the common ink supply path block 42, and the distal end portion of the screw member 80 is fixed to the side surface of the seal member 78. A screw portion 94 is disposed on the side surface of the common ink supply path block 42 so as to be engaged with the screw member 80. When a drive signal is input from the control circuit 89 to the drive portion 85 and the screw member 80 is rotated forward by the drive portion 85, the screw member 80 moves forward to the inside of the common ink supply path block 42 with respect to the screw portion 94, whereas when the screw member 80 is rotated rearward, the screw member 80 is moved rearward to the outside of the common ink supply path block 42 with respect to the screw portion 94.

Note that a movement unit for moving the movable member is not limited to the configuration composed of the screw member 80 and the drive portion 85, and various types of movement mechanisms may be used.

Further, guide shafts 93 are disposed to both end portions in the longitudinal direction of the seal member 78 to guide the seal member 78 along the Y-direction in the drawing. The guide shafts 93 are inserted into circular holes 77 formed to the side surface of the common ink supply path block 42, and moves forward to the inside of the common ink supply path block 42 as well as move rearward to the outside of the common ink supply path block 42 as the screw member 80 moves.

Figure 12A:
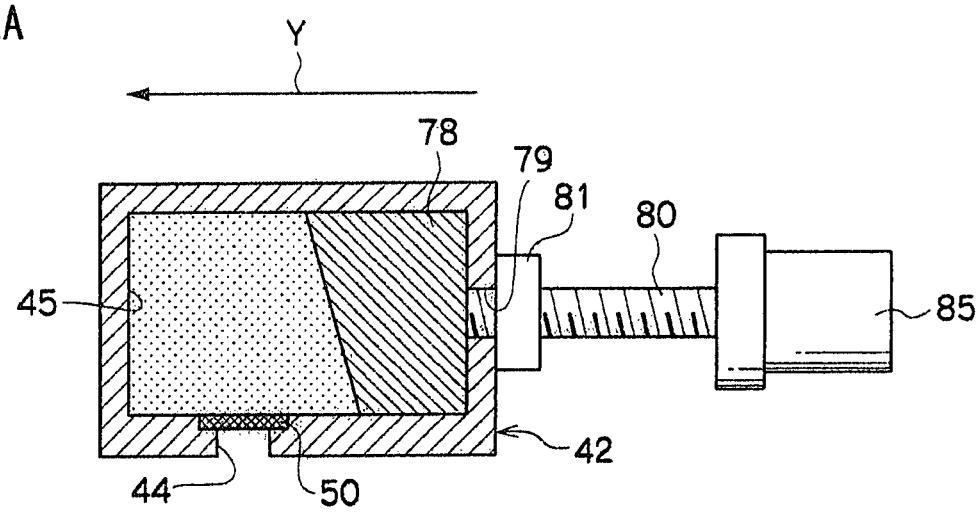
FIG. 12A is a side cross-sectional view showing the third example of the configuration for changing the flow path cross-sectional area of the common ink supply path according to the exemplary embodiment.

As shown in FIG. 12A, the seal member 78 is formed in a trapezoidal shape having an upper side longer than a lower side when viewed along the longitudinal direction of the common ink supply path 45 (when viewed in side view). Note that the shape of the seal member 78 is not limited to the trapezoidal shape as long as the first flow port 71 and the second flow port 72 are not closed in the state that the seal member 78 moves forward and the flow path cross-sectional area of the common ink supply path 45 is made smaller.

In the inkjet recording head 20Y of the third example, the seal member 78 is stopped in such a manner that it moves forward to the side of the first flow part 71 and the second flow port 72 and is abutted against the wall surface of the common ink supply path 45. At this time, the flow path cross-sectional area S2 of the common ink supply path 45 is made smaller than the flow path cross-sectional area S1 of the common ink supply path 45 when the seal member 78 moves rearward (refer to FIG. 7B). As described above, when the flow path cross-sectional area is made smaller, the current of the ink flowing in the flow path of the common ink supply path 45 is increased.

Further, in the inkjet recording head 20Y of the third example, the seal member 78 is stopped in such a manner that it moves rearward and is abutted against the wall surface of the common ink supply path 45. At this time, the flow path cross-sectional area S1 of the common ink supply path 45 is made larger than the flow path cross-sectional area S2 of the common ink supply path 45 when the seal member 78 moves rearward (refer to FIG. 7A).

According to the configuration of the inkjet recording head 20Y of the third example, it has the same operation as the inkjet recording head 20Y of the first example.

Note that the configuration for changing the flow path cross-sectional area of the common ink supply path is not limited to the first, second, and third examples. That is, for example, a configuration may be employed in which a part of the wall surface of the common ink supply path 45 is formed of a flexible film member, and the flow path cross-sectional area of the common ink supply path 45 is changed by pressing the film member with a press member for pressing the film member from the outside surface thereof so that the film member is bent inward as long as the flow path cross-sectional area of the common ink supply path is changed.

Further, in the above first, second, and third examples, when the flow path cross-sectional area of the common ink supply path 45 is changed to be made smaller, the ink outlet ports 44 may be closed.

Figure 8A:
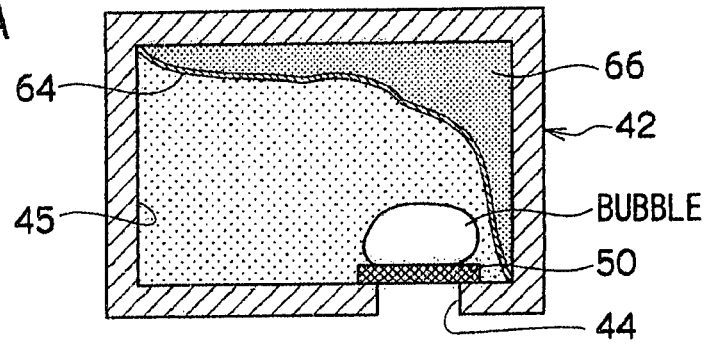
FIG. 8A is a side cross-sectional view showing how a cross-sectional area adjustment chamber according to the exemplary embodiment increases.
Figure 8B:
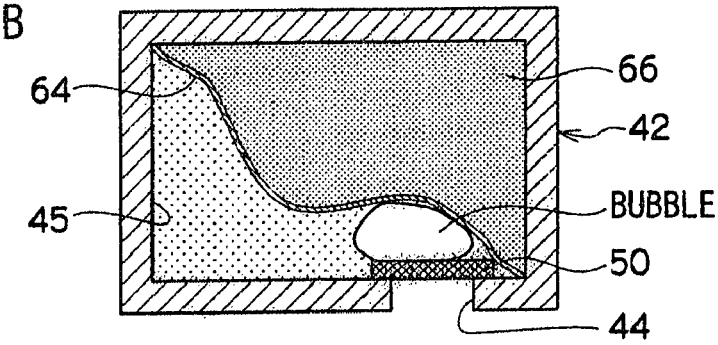
FIG. 8B is a side cross-sectional view showing how the cross-sectional area adjustment chamber according to the exemplary embodiment increases.
Figure 8C:
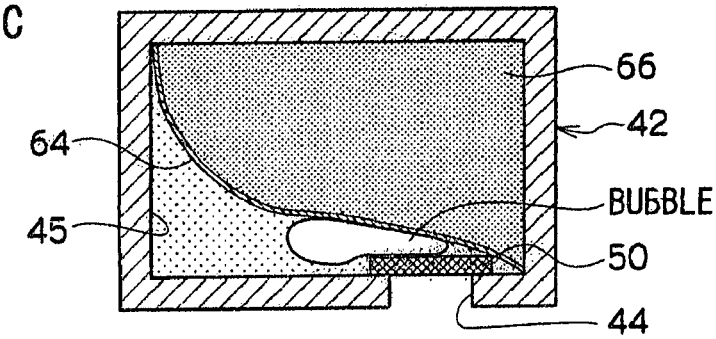
FIG. 8C is a side cross-sectional view showing how the cross-sectional area adjustment chamber according to the exemplary embodiment increases.
Figure 8D:
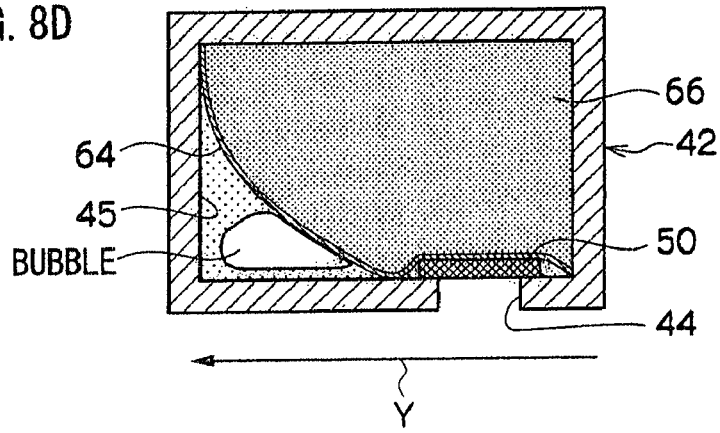
FIG. 8D is a side cross-sectional view showing how the cross-sectional area adjustment chamber according to the exemplary embodiment increases.

In the first example, as shown in FIG. 8D, when the ink is supplied to the cross-sectional area adjustment chamber 66 and the size of the cross-sectional area adjustment chamber 66 enlarges to a predetermined size, the film member 64 is placed on the ink outlet ports 44 so as to cover them to thereby close the ink outlet ports 44. With this configuration, the ink is unlike to flow into the ink inlet ports 43 through the ink outlet ports 44. As a result, even if the ink is circulated by the pressure or the negative pressure applied to the common ink supply path 45 when bubbles are removed from the common ink supply path 45, the pressure change caused in the common ink supply path 45 is suppressed from being transmitted to the head unit portion 40.

Figure 13A:
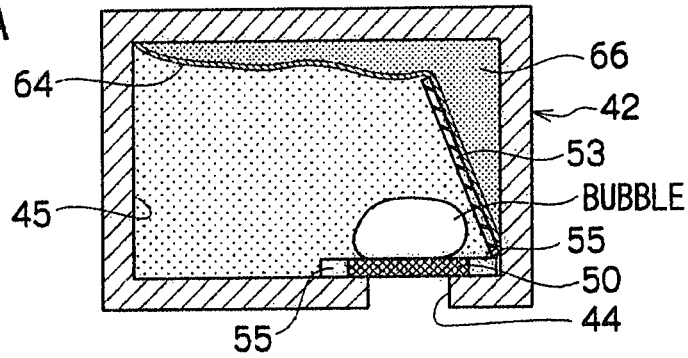
FIG. 13A is a side cross-sectional view showing the configuration in which a seal member for sealing the ink outlet ports is disposed to a film member.
Figure 13B:
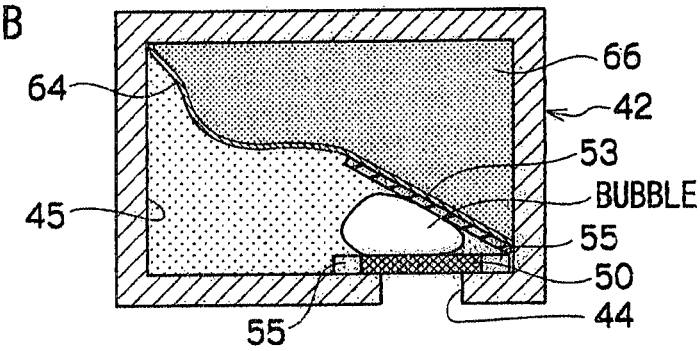
FIG. 13B is a side cross-sectional view showing the configuration in which the seal member for sealing the ink outlet ports is disposed to the film member.
Figure 13C:
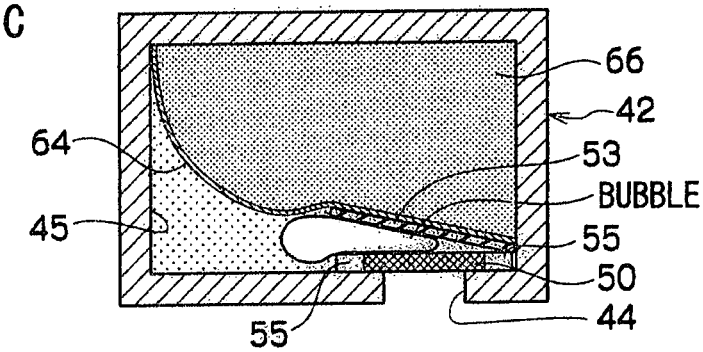
FIG. 13C is a side cross-sectional view showing the configuration in which the seal member for sealing the ink outlet ports is disposed to the film member.
Figure 13D:
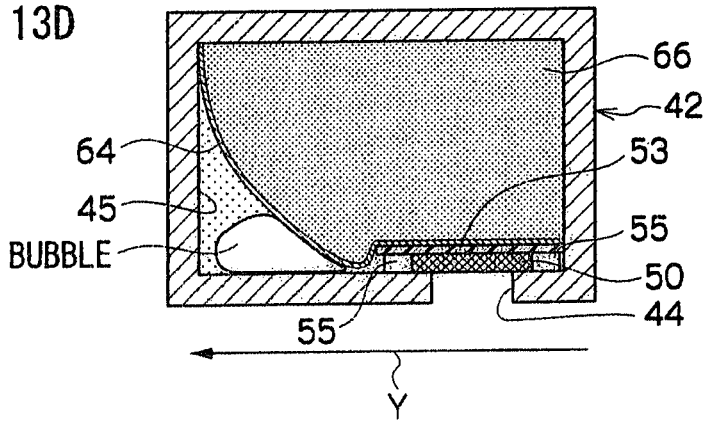
FIG. 13D is a side cross-sectional view showing the configuration in which the seal member for sealing the ink outlet ports is disposed to the film member.

Further, as shown in FIGS. 13A, 13B, 13C, and 13D, the seal member 53 for sealing the ink outlet ports 44 may be disposed on the surface of the film member 64. In the configuration shown in FIGS. 13A, 13B, 13C, and 13D, since ribs 55 are formed to the edge portions of the ink outlet ports 44 (outer peripheral portions of the filters 50), when the film member 64 is placed on the filters 50 so as to cover it, the seal member 53 comes into intimate contact with the ribs 55 as shown in FIG. 13D to thereby seal the ink outlet ports 44. A rubber packing, for example, is used as the seal member 53.

Figure 14A:
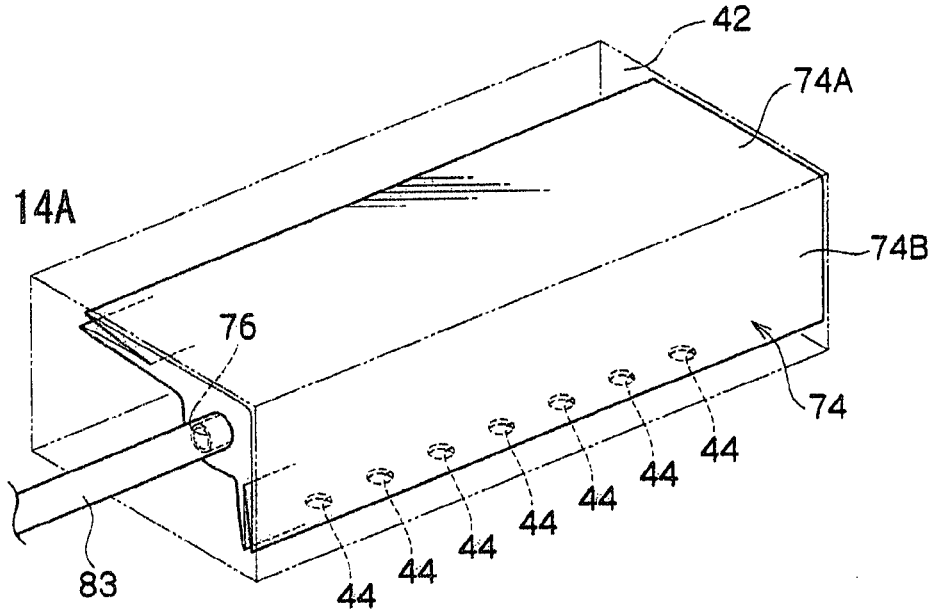
FIG. 14A is a view showing the configuration for closing the ink outlet ports when the flow path cross-sectional area of the common ink supply path is changed in the second example of the configuration for changing the flow path cross-sectional area of the common ink supply path.
Figure 14B:
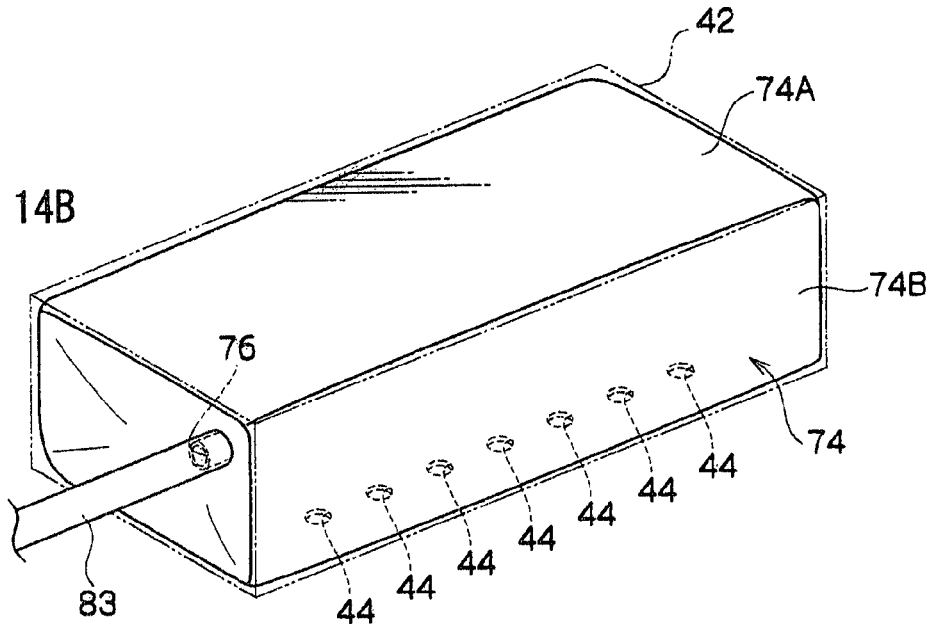
FIG. 14B is a view showing the configuration for closing the ink outlet ports when the flow path cross-sectional area of the common ink supply path is changed in the second example of the configuration for changing the flow path cross-sectional area of the common ink supply path.

In the second example, as shown in FIGS. 14A and 14B, when the ink is supplied to the inside of the bag member 74 and the size of the bag member 74 enlarges to a predetermined size, the bag member 74 is placed on the filters 50 so as to cover it to thereby close the ink outlet ports 44. With this configuration, the ink is unlike to flow into the ink inlet ports 43 through the ink outlet ports 44. As a result, even if the ink is circulated by the pressure or the negative pressure applied to the common ink supply path 45 when bubbles are removed from the common ink supply path 45, the pressure change caused in the common ink supply path 45 is suppressed from being transmitted to the head unit portion 40.

Figure 15A:
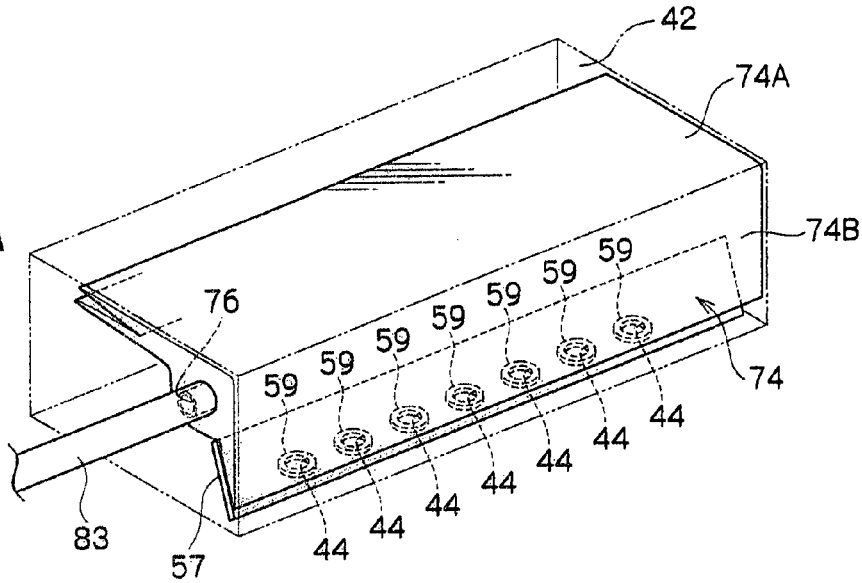
FIG. 15A is a view showing the configuration in which the seal member for sealing the ink outlet ports is disposed to a bag member in the configuration of FIGS. 14A and 14B.
Figure 15B:
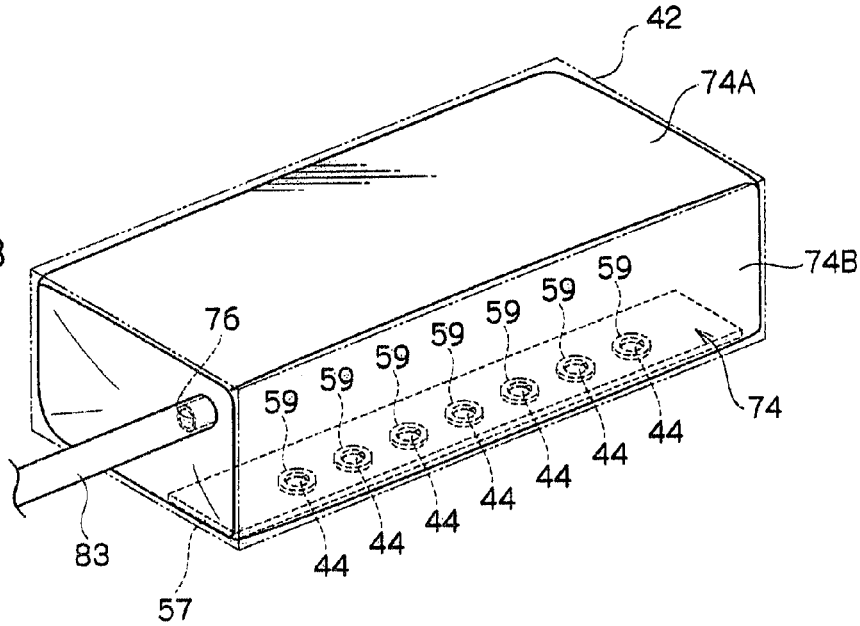
FIG. 15B is a view showing the configuration in which the seal member for sealing the ink outlet ports is disposed to the bag member in the configuration of FIGS. 14A and 14B.

Further, as shown in FIGS. 15A and 15B, a seal member 57 for sealing the ink outlet ports 44 may be disposed on the surface of the bag member 74. In the configuration shown in FIGS. 15A and 15B, since ribs 59 are formed to the edge portions of the ink outlet ports 44 (outer peripheral portions of filters 50), when the bag member 74 is placed on the filters 50 so as to cover it, the seal member 57 comes into intimate contact with the ribs 59 to thereby seal the ink outlet ports 44. A rubber packing, for example, is used as the seal member 57.

In the third example, the upper surface of the seal member 78 is formed larger than the lower surface thereof, and the lower surface is formed to a size capable of closing the ink outlet ports 44.

Figure 12B:
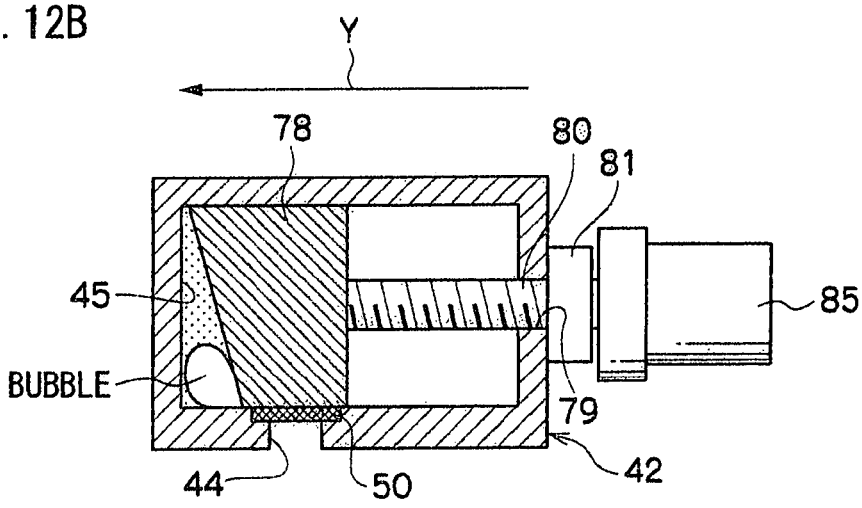
FIG. 12B is a side cross-sectional view showing the third example of the configuration for changing the flow path cross-sectional area of the common ink supply path according to the exemplary embodiment.

In the ink jet recording head 20Y of the third example, as shown in FIG. 12B, when the seal member 78 is stopped in such a manner that it moves forward to the side of the first flow port 71 and the second flow port 72 and is abutted against the wall surface of the common ink supply path 45, the lower surface of the seal member 78 covers the ink outlet ports 44 to thereby close he ink outlet ports 44. With this configuration, the ink is unlike to flow into the ink inlet ports 43 through the ink outlet ports 44. As a result, even if the ink is circulated by the pressure or the negative pressure applied to the common ink supply path 45 when bubbles are removed from the common ink supply path 45, the pressure change caused in the common ink supply path 45 is suppressed from being transmitted to the head unit portion 40.

Note that the configuration for closing the ink outlet ports 44 in the first, second, and third examples as described above may be omitted, and a configuration for not closing the ink outlet ports 44 may be employed.

The present invention is not limited to the above exemplary embodiment and may be variously modified, altered, and improved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting head comprising:

a liquid droplet ejecting element for ejecting liquid droplets;

a liquid supply path having two or more flow ports, through which a liquid can flow, and supplying the liquid flowing in from the flow ports to the liquid droplet ejecting element; and a flow path cross-sectional area variable unit for changing the flow path cross-sectional area of the liquid supply path, wherein the flow path cross-sectional area variable unit comprises a cross-sectional area adjustment chamber and a medium supply/discharge port capable of supplying a medium to the cross-sectional area adjustment chamber as well as discharging the medium from the cross-sectional area adjustment chamber.

2. The liquid droplet ejecting head according to claim 1, wherein a cross-sectional area adjustment chamber is formed of a flexible film member and a wall surface of the liquid supply path.

3. The liquid droplet ejecting head according to claim 1, wherein the flow path cross-sectional area variable unit comprises a movable member that constitutes a part of a wall surface of the liquid supply path and can move in a direction in which the flow path cross-sectional area of the liquid supply path is changed.

4. A liquid droplet ejecting apparatus comprising:

the liquid droplet ejecting head according to claim 1;

a liquid storage unit for storing the liquid supplied to the liquid supply path;

a bubble removal unit for supplying the liquid stored in the liquid storage unit from one of the flow ports to the liquid supply path and discharging the liquid in the liquid supply path from the other flow port to thereby remove bubbles from the liquid supply path; and a control unit for controlling, when the bubble removal unit removes the bubbles, the supply path cross-sectional area variable unit so that the cross-sectional area of the liquid supply path is made smaller than the case in which the liquid is supplied to the liquid droplet ejecting element to eject liquid droplets from the liquid droplet ejecting element.

5. A liquid droplet ejecting head comprising:

a liquid droplet ejecting element for ejecting liquid droplets;

a liquid supply path having two or more flow ports, through which a liquid can flow, and supplying the liquid flowing in from the flow ports to the liquid droplet ejecting element; and a flow path cross-sectional area variable unit for changing the flow path cross-sectional area of the liquid supply path, wherein the flow path cross-sectional area variable unit comprises a flexible bag member disposed in the liquid supply path and a medium supply/discharge port capable of supplying a medium to the inside of the bag member as well as discharging the medium from the inside of the bag member.

6. A liquid droplet ejecting head comprising:

a liquid droplet ejecting element for ejecting liquid droplets;

a liquid supply path having two or more flow ports, through which a liquid can flow, and supplying the liquid flowing in from the flow ports to the liquid droplet ejecting element; and a flow path cross-sectional area variable unit for changing the flow path cross-sectional area of the liquid supply path;

the liquid supply path has a supply port for supplying the liquid flowing in from the flow port to the liquid droplet ejecting element; and the flow path cross-sectional area variable unit closes the supply port when the flow path cross-sectional area of the liquid supply path is changed so that the flow path cross-sectional area is made smaller.

7. The liquid droplet ejecting head according to claim 6, wherein the flow path cross-sectional area variable unit comprises a cross-sectional area adjustment chamber formed of a flexible film member and a wall surface of the liquid supply path and a medium supply/discharge port capable of supplying a medium to the cross-sectional area adjustment chamber as well as discharging the medium from the cross-sectional area adjustment chamber, and further closes the supply port by the film member.

8. The liquid droplet ejecting head according to claim 7, further comprising a seal member disposed at the film member for sealing the supply port.

9. The liquid droplet ejecting head according to claim 6, wherein the flow path cross-sectional area variable unit comprises a flexible bag member disposed in the liquid supply path and a medium supply/discharge port capable of supplying a medium to the inside of the bag member as well as discharging the medium from the inside of the bag member, and further closes the supply port by the bag member.

10. The liquid droplet ejecting head according to claim 9, further comprising a seal member disposed at the bag member for sealing the supply port.

11. The liquid droplet ejecting head according to claim 6, wherein the flow path cross-sectional area variable unit comprises a movable member that constitutes a part of a wall surface of the liquid supply path and can move in a direction in which the flow path cross-sectional area of the liquid supply path is changed, and further closes the supply port by an edge surface of the movable member.

12. A liquid droplet ejecting apparatus comprising:

the liquid droplet ejecting head according to claim 6;

a liquid storage unit for storing the liquid supplied to the liquid supply path;

a bubble removal unit for supplying the liquid stored in the liquid storage unit from one of the flow ports to the liquid supply path and discharging the liquid in the liquid supply path from the other flow port to thereby remove bubbles from the liquid supply path; and a control unit for controlling, when the bubble removal unit removes the bubbles, the supply path cross-sectional area variable unit so that the cross-sectional area of the liquid supply path is made smaller than the case in which the liquid is supplied to the liquid droplet ejecting element to eject the liquid droplets from the liquid droplet ejecting element.

13. The liquid droplet ejecting apparatus according to claim 12, wherein:

the flow path cross-sectional area variable unit comprises a cross-sectional area adjustment chamber formed of a flexible film member and a wall surface of the liquid supply path and a medium supply/discharge, port capable of supplying a medium to the cross-sectional area adjustment chamber as well as discharging the medium from the cross-sectional area adjustment chamber, and further closes the supply port by the film member;

the liquid droplet ejecting apparatus comprises a medium supply/discharge unit for supplying the medium to the cross-sectional area adjustment chamber through the medium supply/discharge port and discharging the medium from the cross-sectional area adjustment chamber through the medium supply/discharge port; and the control unit controls the medium supply/discharge unit such that when the bubbles are removed, the medium is supplied to the cross-sectional area adjustment chamber, and when the liquid is supplied to the liquid droplet ejecting element to eject liquid droplets from the liquid droplet ejecting element, the medium is discharged from the cross-sectional area adjustment chamber.

14. The liquid droplet ejecting apparatus according to claim 12, wherein:

the flow path cross-sectional area variable unit comprises a flexible bag member disposed in the liquid supply path and a medium supply/discharge port capable of supplying a medium to the inside of the bag member as well as discharging the medium from the inside of the bag member, and further closes the supply port by the bag member;

the liquid droplet ejecting apparatus comprises a medium supply/discharge unit for supplying the medium to the inside of the bag member through the medium supply/discharge port and discharging the medium from the inside of the bag member through the medium supply/discharge port; and the control unit controls the medium supply/discharge unit such that when the bubbles are removed, the medium is supplied to the inside of the bag member, and when the liquid is supplied to the liquid droplet ejecting element to eject liquid droplets from the liquid droplet ejecting element, the medium is discharged from the inside of the bag member.

15. The liquid droplet ejecting apparatus according to claim 13, wherein the medium supply/discharge unit supplies the liquid stored in the liquid storage unit as the medium to the cross-sectional area adjustment chamber and discharges the liquid stored in the liquid storage unit as the medium from the cross-sectional area adjustment chamber.

16. The liquid droplet ejecting apparatus according to claim 12, wherein:

the flow path cross-sectional area variable unit comprises a movable member that constitutes a part of a wall surface of the liquid supply path and can move in a direction in which the flow path cross-sectional area of the liquid supply path is changed, and further closes the supply port by an edge surface of the movable member;

the liquid droplet ejecting apparatus comprises a movement unit for moving the movable member in a direction in which the cross-sectional area of the liquid supply path is changed; and the control unit controls the movement unit such that when the bubbles are removed, the movable member moves in a direction in which the cross-sectional area of the liquid supply path is made smaller, and when the liquid is supplied to the liquid droplet ejecting element to eject liquid droplets from the liquid droplet ejecting element, the movable member moves in a direction in which the cross-sectional area of the liquid supply path is made larger.

17. A liquid droplet ejecting apparatus comprising:

a liquid droplet ejecting head including:

a liquid droplet electing element for electing liquid droplets;

a liquid supply path having two or more flow ports, through which a liquid can flow, and supplying the liquid flowing in from the flow ports to the liquid droplet ejecting element; and a flow path cross-sectional area variable unit for changing the flow path cross-sectional area of the liquid supply path;

a liquid storage unit for storing the liquid supplied to the liquid supply path;

a bubble removal unit for supplying the liquid stored in the liquid storage unit from one of the flow ports to the liquid supply path and discharging the liquid in the liquid supply path from the other flow port to thereby remove bubbles from the liquid supply path; and a control unit for controlling, when the bubble removal unit removes the bubbles, the supply path cross-sectional area variable unit so that the cross-sectional area of the liquid supply path is made smaller than the case in which the liquid is supplied to the liquid droplet ejecting element to eject liquid droplets from the liquid droplet ejecting element;

the flow path cross-sectional area variable unit comprises a cross-sectional area adjustment chamber formed of a flexible film member and a wall surface of the liquid supply path and a medium supply/discharge port capable of supplying a medium to the cross-sectional area adjustment chamber as well as discharging the medium from the cross-sectional area adjustment chamber;

the liquid droplet ejecting apparatus comprises a medium supply/discharge unit for supplying the medium to the cross-sectional area adjustment chamber through the medium supply/discharge port and discharging the medium from the cross-sectional area adjustment chamber through the medium supply/discharge port; and the control unit controls the medium supply/discharge unit such that when the bubbles are removed, the medium is supplied to the cross-sectional area adjustment chamber, and when the liquid is supplied to the liquid droplet ejecting element to eject liquid droplets from the liquid droplet ejecting element, the medium is discharged from the cross-sectional area adjustment chamber.

18. The liquid droplet ejecting apparatus according to claim 17, wherein the medium supply/discharge unit supplies the liquid stored in the liquid storage unit, as the medium to the cross-sectional area adjustment chamber and discharges the liquid stored in the liquid storage unit as the medium from the cross-sectional area adjustment chamber.

19. The liquid droplet ejecting apparatus according to claim 17, wherein:

the flow path cross-sectional area variable unit comprises a movable member that constitutes a part of a wall surface of the liquid supply path and can move in a direction in which the flow path cross-sectional area of the liquid supply path is changed;

the liquid droplet ejecting apparatus comprises a movement unit for moving the movable member in a direction in which the cross-sectional area of the liquid supply path is changed; and the control unit controls the movement unit such that when the bubbles are removed, the movable member moves in a direction in which the cross-sectional area of the liquid supply path is made smaller, and when the liquid is supplied to the liquid droplet ejecting element to eject liquid droplets from the liquid droplet ejecting element, the movable member moves in a direction in which the cross-sectional area of the liquid supply path is made larger.

20. A liquid droplet ejecting apparatus comprising:

a liquid droplet electing head including:

a liquid droplet ejecting element for ejecting liquid droplets;

a liquid supply path having two or more flow ports, through which a liquid can flow, and supplying the liquid flowing in from the flow ports to the liquid droplet electing element; and a flow path cross-sectional area variable unit for changing the flow path cross-sectional area of the liquid supply path;

a liquid storage unit for storing the liquid supplied to the liquid supply path;

a bubble removal unit for supplying the liquid stored in the liquid storage unit from one of the flow ports to the liquid supply path and discharging the liquid in the liquid supply path from the other flow port to thereby remove bubbles from the liquid supply path; and a control unit for controlling, when the bubble removal unit removes the bubbles, the supply path cross-sectional area variable unit so that the cross-sectional area of the liquid supply path is made smaller than the case in which the liquid is supplied to the liquid droplet ejecting element to eject liquid droplets from the liquid droplet ejecting element;

the flow path cross-sectional area variable unit comprises a flexible bag member disposed in the liquid supply path and a medium supply/discharge port capable of supplying a medium to the inside of the bag member as well as discharging the medium from the inside of the bag member;

the liquid droplet ejecting apparatus comprises a medium supply/discharge unit for supplying the medium to the inside of the bag member through the medium supply/discharge port and discharging the medium from the inside of the bag member through the medium supply/discharge port; and the control unit controls the medium supply/discharge unit such that when the bubbles are removed, the medium is supplied to the inside of the bag member, and when the liquid is supplied to the liquid droplet ejecting element to eject liquid droplets from the liquid droplet ejecting element, the medium is discharged from the inside of the bag member.

21. The liquid droplet ejecting apparatus according to claim 20, wherein:

the flow path cross-sectional area variable unit comprises a movable member that constitutes a part of a wall surface of the liquid supply path and can move in a direction in which the flow path cross-sectional area of the liquid supply path is changed;

the liquid droplet ejecting apparatus comprises a movement unit for moving the movable member in a direction in which the cross-sectional area of the liquid supply path is changed; and the control unit controls the movement unit such that when the bubbles are removed, the movable member moves in a direction in which the cross-sectional area of the liquid supply path is made smaller, and when the liquid is supplied to the liquid droplet ejecting element to eject liquid droplets from the liquid droplet ejecting element, the movable member moves in a direction in which the cross-sectional area of the liquid supply path is made larger.

* * * * *